US011970762B2

(12) United States Patent
Pethe et al.

(10) Patent No.: US 11,970,762 B2
(45) Date of Patent: Apr. 30, 2024

(54) HARD GOLD ALLOY WITH ZIRCONIUM, TITANIUM AND MAGNESIUM FOR JEWELRY MANUFACTURE

(71) Applicants: Subodh Pethe, Mumbai (IN); Sharad Parab, Mumbai (IN)

(72) Inventors: Subodh Pethe, Mumbai (IN); Sharad Parab, Mumbai (IN)

( * ) Notice: Subject to any disclaimer, the term of this patent is extended or adjusted under 35 U.S.C. 154(b) by 475 days.

(21) Appl. No.: 16/623,282

(22) PCT Filed: Jun. 28, 2017

(86) PCT No.: PCT/IN2017/050266
§ 371 (c)(1),
(2) Date: Dec. 16, 2019

(87) PCT Pub. No.: WO2018/178998
PCT Pub. Date: Oct. 4, 2018

(65) Prior Publication Data

US 2020/0216931 A1 Jul. 9, 2020

(30) Foreign Application Priority Data

Mar. 27, 2017 (IN) ..... 201721010746

(51) Int. Cl.
*C22C 5/02* (2006.01)

(52) U.S. Cl.
CPC ..... *C22C 5/02* (2013.01)

(58) Field of Classification Search
CPC ..... C22C 5/02; C22F 1/14
See application file for complete search history.

(56) References Cited

U.S. PATENT DOCUMENTS 1,731,210 A * 10/1929 Davignon ..... C22C 5/02 420/580
2007/0113707 A1* 5/2007 Cascone ..... A61C 13/0022 75/637
2014/0305164 A1 10/2014 Lauper et al.
2015/0368757 A1* 12/2015 Dubos ..... C22C 5/02 420/508

FOREIGN PATENT DOCUMENTS

IN MUM 2012 0263 A 4/2013
JP 03130334 A * 6/1991
WO 2009092920 A2 7/2009

OTHER PUBLICATIONS

Supertool Inc, Feeds & Speeds for Mills & Saws—Carbide Tipped, http://www.supertoolinc.com/uploads/MillingFeedsandSpeeds.pdf, May 31, 2011 (Year: 2011).*
International Search Report for PCT/IN2017/050266, dated Nov. 24, 2017.
Corti, "Metallurgy of Microalloyed 24 Carat Golds", Gold Bulletin 1999, 32(2), pp. 39-47.
Corti, "The Next 10 Years: Jewellery Manufacturing in 2024!", Jewelry Technology Forum 2014, pp. 1-10.
Gafner, "The development of 990 gold-titanium, and its production, use, and properties", J. S. Afr. Inst. Min. Metal., vol. 89, No. 6. Jun. 1989. pp. 173-181.
Massalski, et al., "The Au—Zr (Gold-Zirconium System)", Bulletin of Alloy Phase Diagrams, vol. 6, No. 6 (1985) pp. 519-522.
Suss, "18 Carat Yellow Gold Alloys with Increased Hardness", Gold Bulletin 2004 (37) 3-4, pp. 196-207.

* cited by examiner

*Primary Examiner* — Anthony M Liang
*Assistant Examiner* — Jacob J Gusewelle
(74) *Attorney, Agent, or Firm* — Kramer & Amado, P.C.

(57) ABSTRACT

A high purity gold alloy alloyed with at least two of the metals zirconium, titanium and magnesium for jewelry manufacture, containing 75-99.5% Gold; at least two of 0.01-1.5% Zirconium, 0.01-1.5% Magnesium, and 0.01-1.5% Titanium; 0-24.98% Copper; 0-24.98% Zinc; and 0-24.98% Silver by weight. The gold alloy has 75-260 Vickers hardness and specific gravity 14-19 g/cc. A gold alloy with zirconium, magnesium, and titanium has a rich yellow colour. A gold alloy with zirconium and magnesium has a greenish yellow colour. A gold alloy with zirconium and titanium has a whitish yellow colour. A gold alloy with magnesium and titanium has a pale yellow colour. The gold alloy shows low wear during polishing. The gold alloy includes 18-24 Caratage, suitable for jewelry manufacture due to its low specific gravity.

23 Claims, No Drawings

HARD GOLD ALLOY WITH ZIRCONIUM, TITANIUM AND MAGNESIUM FOR JEWELRY MANUFACTURE

FIELD OF INVENTION

The present invention relates to gold alloys. In particular, the present invention relates to gold alloys which are alloyed with Zirconium, Titanium and Magnesium. More particularly, the present invention relates to gold alloys alloyed with at least two out of zirconium, Titanium and Magnesium or all three together for making low-weight jewelry of different caratages.

BACKGROUND OF THE INVENTION

Gold is one of the most expensive but popular rare metal, predominantly used for manufacturing jewelry and watches etc. Normally, the conventional 22 and 23-carat Gold alloy has gold of fineness 916 (916 part out of total 1000) and 958 (958 ppt or 958 parts out of total 1000) respectively. The remaining 84 part in 22-carat Gold and 42 parts in 23-carat Gold (out of a total of 1000 parts) including Thailand 23-carat Gold consisting 96.15 to 96.55% by weight of Gold and includes several alloying elements, such as Zinc as well as Copper and Silver which are abundantly available in pure metal form. In India, Copper and Silver are the only alloying elements traditionally used for making conventional 22 and 23-carat Gold.

The compositions (by weight) of conventional Gold alloys of different caratage are indicated below:

A) 18-carat Gold: 75% Gold, 12.5% Copper and 12.5% Silver and

B) 22-carat Gold: 91.6% Gold, 6.3% Copper and 2.1% Silver.

Although, for commercial and industrial application, few common items are available in Indian market using the terms like Zirconium and Zirconia, they do not actually possess any Zirconium metal in its pure form, which is actually included here as the subject-matter of the present invention.

Normally, Zirconium jewelry is made of Zirconium or alloys thereof containing Zirconium as the main alloying constituent. While cubic Zirconia commonly known as CZ is a synthesized crystalline form of Zirconium Dioxide and is commercially used as a diamond simulant. Another form of zircon falls under the category of gemstones having a chemical formula as $ZrSiO4$ (Zirconium Silicate).

According to the article "The Au—Zr (Gold-Zirconium) Systems" written by Massalski, T. B., Okamoto, H. & Abriata and published in the J. P. Bulletin of Alloy Phase Diagrams (1985) [6: 519. doi: 10.1007/BF02887148], Zirconium has 7.25% of solubility in Gold. However, for the applications in jewelry manufacture, in which the cold workability in items is very important, in another article "18-carat yellow gold alloys with increased hardness" (page 7) written by Mintek, it is stated that more than 5% of Zirconium solubility in gold leads to cracking of items.

A solid solution strengthening phenomenon is observed in this alloy as seen in a solid-state, there is a different fraction of solubility of 1% of Zirconium in Gold from the temperature between 800-400-degree Celsius, according to the article "Micro-alloyed 24-carat Gold" (Page 7, Table 6) written by C. W *Corti*.

Since the Zirconium atom has a misfit factor 11.11 with the Gold atom, there is a substitutional strengthening (misfit factor of more than 15) effect on the alloys. Apart from jewelry manufacture, the Gold-Zirconium alloy is also found useful in:

a) Dental applications, in which Gold has been used for more than 4000 years as a restorative material, particularly for dental repairs. For having special characteristics by and in the alloy that could make its use extensively in dental field, Gold-Zirconium is an important alloy to be considered.

b) Electrical Applications for special purpose application, in which Gold is used as a contact material because of its advantageous properties such as abrasion resistance and hardness etc., the Gold-Zirconium alloy offers a good applicability here as well.

Moreover, different articles discuss the micro-alloyed Gold, for example, the article written by C. W. Corti: "MICROALLOYING_CORTI_JTF2005_ENG.pdf-132-147 CORTI_eng col (page 10-11 and References) and available online and another article written by Geoffrey Gafner: "The Development of 990 Gold-Titanium: It's Production, use and properties" (page 1&9).

However, none of the compositions disclosed in the prior art literature include combinations of at least two out of these three, Zirconium, Titanium and Magnesium metals or all three together as the constituents of the gold alloy.

DISADVANTAGES WITH THE PRIOR ART

The disadvantages with the prior art documents are that none of the documents found during this search have exhibited all the features of the applicant's NEW Gold alloy compositions having 18 to 24 carats, which they claim to have lower grammage with same volume as in the conventional high caratages and increased hardening value and to maintain ductility, colour, tensile strength and other properties of gold essential for jewelry making and easy for refining.

OBJECTS OF THE INVENTION

Some of the objects of the present invention—satisfied by at least one embodiment of the present invention—are as follows:

An object of the present invention is to provide a gold alloy with a combination of metals zirconium, Titanium and Magnesium or all three together for jewelry manufacture which has improved mechanical properties.

Another object of the present invention is to provide a gold alloy with at least two out of zirconium, Titanium and Magnesium or all three together for jewelry manufacture which has improved mechanical properties.

Still another object of the present invention is to provide a gold alloy with at least two out of zirconium, Titanium and Magnesium or all three together for jewelry manufacture which has lower weight for the same volume of the conventional alloy.

Yet another object of the present invention is to provide a gold alloy with at least two out of zirconium, Titanium and Magnesium or all three together for jewelry manufacture which retains rich yellow colour of the gold after alloying.

A further object of the present invention is to provide a gold alloy with at least two out of zirconium, Titanium and Magnesium or all three together for jewelry manufacture which has workable malleability and ductility during jewelry making.

A still further object of the present invention is to provide a gold alloy with at least two out of zirconium, Titanium and Magnesium or all three together for jewelry manufacture which has improved hardness.

A yet further object of the present invention is to provide a gold alloy with at least two out of zirconium, Titanium and Magnesium or all three together for jewelry manufacture which has age-hardening property.

One more object of the present invention is to provide a gold alloy with at least two out of zirconium, Titanium and Magnesium or all three together for jewelry manufacture which has better/improved springiness.

A still more object of the present invention a gold alloy with at least two out of zirconium, Titanium and Magnesium or all three together for jewelry manufacture which shows higher resistance to wear. A yet more object of the present invention a gold alloy with at least two out of zirconium, Titanium and Magnesium or all three together for jewelry manufacture which shows higher luster.

These and other objects and advantages of the present invention will become more apparent from the following description, when read with the accompanying data and tables which are however not intended to limit the scope of the present invention in any way.

SUMMARY OF THE INVENTION

In accordance with the present invention, there is provided a high purity gold alloy alloyed with a combination of metals zirconium, Titanium and Magnesium for jewelry manufacture, the gold alloy comprising:

75 to 99.5% by weight of gold,
0.01 to 1.5% by weight of zirconium, and/or
0.01 to 1.5% by weight of magnesium, and/or
0.01 to 1.5% by weight of titanium, and/or
0 to 24.98% by weight of copper,
0 to 24.98% by weight of zinc,
0 to 24.98% by weight of silver.

Typically, the gold alloy is an 18-carat Gold alloy comprising:

75 to 75.5% by weight of gold,
0.01 to 1.5% by weight of magnesium,
0.01 to 1.5% by weight of titanium,
0.01 to 1.5% by weight of zirconium,
0 to 24.97% by weight of copper,
0 to 24.97% by weight of zinc, and
0 to 24.97% by weight of silver.

Typically, the gold alloy is a 21-carat Gold alloy comprising:

87.5 to 88% by weight of gold,
0.01 to 1.5% by weight of magnesium,
0.01 to 1.5% by weight of titanium,
0.01 to 1.5% by weight of zirconium,
0 to 12.47% by weight of copper,
0 to 12.47% by weight of zinc, and
0 to 12.47% by weight of silver.

Typically, the gold alloy is a 22-carat Gold alloy comprising:

91.6 to 92% by weight of gold,
0.01 to 1.5% by weight of magnesium,
0.01 to 1.5% by weight of titanium,
0.01 to 1.5% by weight of zirconium,
0 to 8.37% by weight of copper,
0 to 8.37% by weight of zinc, and
0 to 8.37% by weight of silver.

Typically, the gold alloy is a 23-carat Gold alloy comprising:

95.8 to 97% by weight of gold,
0.01 to 1.5% by weight of magnesium,
0.01 to 1.5% by weight of titanium,
0.01 to 1.5% by weight of zirconium,
0 to 4.17% by weight of copper,
0 to 4.17% by weight of zinc, and
0 to 4.17% by weight of silver.

Typically, the gold alloy is a 24-carat Gold alloy comprising:

97 to 99.5% by weight of gold,
0.01 to 1.5% by weight of magnesium,
0.01 to 1.5% by weight of titanium, and
0.01 to 1.5% by weight of Zirconium.

Typically, the gold alloy has a specific gravity in the range of 14 to 19.5 g/cc; preferably 14.67 g/cc, 16.502 g/cc, 17.057 g/cc, 17.88 g/cc and 18.771 g/cc for 18, 21, 22, 23 and 24-carat gold alloy respectively.

Typically, the gold alloy comprises a hardness in the range of 75 to 260 Vickers HV-0.05 ASM F 384-11; preferably 240-260, 200-225, 170-195, 125-155 and 75-100 Vickers HV-0.05 ASM F 384-11 for 18, 21, 22, 23 and 24-carat gold alloy respectively.

Typically, the gold alloy has substantially higher springiness, luster and lower wear and has rich yellow color and compatible color retention properties compared with conventional Gold alloy.

In another embodiment of the present invention, the gold alloy is alloyed with at least two metals out of zirconium, Titanium and Magnesium for jewelry manufacture and comprises:

75 to 99.5% by weight of gold,
0.01 to 1.5% by weight of zirconium, and/or
0.01 to 1.5% by weight of magnesium, and/or
0.01 to 1.5% by weight of titanium, and/or
0 to 24.98% by weight of copper,
0 to 24.98% by weight of zinc,
0 to 24.98% by weight of silver.

Typically, the gold alloy is a whitish yellow 18-carat Gold alloy comprising:

75 to 75.5% by weight of gold,
0.01 to 1.5% by weight of zirconium,
0.01 to 1.5% by weight of titanium,
0 to 24.98% by weight of copper,
0 to 24.98% by weight of zinc, and
0 to 24.98% by weight of silver.

Typically, the gold alloy is a greenish yellow 18-carat Gold alloy comprising:

75 to 75.5% by weight of gold,
0.01 to 1.5% by weight of zirconium,
0.01 to 1.5% by weight of magnesium,
0 to 24.98% by weight of copper,
0 to 24.98% by weight of zinc, and
0 to 24.98% by weight of silver.

Typically, the gold alloy is a pale yellow 18-carat Gold alloy comprising:

75 to 75.5% by weight of gold,
0.01 to 1.5% by weight of magnesium,
0.01 to 1.5% by weight of titanium,
0 to 24.98% by weight of copper,
0 to 24.98% by weight of zinc, and
0 to 24.98% by weight of silver.

Typically, the gold alloy has a specific gravity in the range of 14 to 15 g/cc; preferably 14.78 g/cc., 14.75-g/cc and 14.74 g/cc for Zr—Ti, Zr—Mg and Ti—Mg of the 18-carat gold alloy respectively. Typically, the gold alloy comprises a hardness in the range of 235 to 265 Vickers HV-0.05 ASM F 384-11, preferably 245-265, 235-255 and 245-255 Vickers HV-0.05 ASM F 384-11 for Zr—Ti, Zr—Mg and Ti—Mg of the 18-carat gold alloy respectively.

Typically, the gold alloy has substantially higher springiness, luster and lower wear and has compatible color retention properties compared with conventional Gold alloy.

In yet another embodiment of the present invention, the gold alloy is a whitish yellow 21-carat Gold alloy comprising:

87.5 to 88% by weight of gold,
0.01 to 1.5% by weight of zirconium,
0.01 to 1.5% by weight of titanium,
0 to 12.48% by weight of copper,
0 to 12.48% by weight of zinc, and
0 to 12.48% by weight of silver.

Typically, the gold alloy is a greenish yellow 21-carat Gold alloy comprising:

87.5 to 88% by weight of gold,
0.01 to 1.5% by weight of zirconium,
0.01 to 1.5% by weight of magnesium,
0 to 12.48% by weight of copper,
0 to 12.48% by weight of zinc, and
0 to 12.48% by weight of silver.

Typically, the gold alloy is a pale yellow 21-carat Gold alloy comprising:

87.5 to 88% by weight of gold,
0.01 to 1.5% by weight of magnesium,
0.01 to 1.5% by weight of titanium,
0 to 12.48% by weight of copper,
0 to 12.48% by weight of zinc, and
0 to 12.48% by weight of silver.

Typically, the gold alloy has a specific gravity in the range of 16 to 17 g/cc; preferably 16.69 g/cc, 16.55 g/cc, 16.51 g/cc for Zr—Ti, Zr—Mg and Ti—Mg of the 21-carat combinations respectively. Typically, the gold alloy comprises a hardness in the range of 200 to 230 Vickers HV-0.05 ASM F 384-11, preferably 205-230, 200-210 and 200-225 Vickers HV-0.05 ASM F 384-11 for Zr—Ti, Zr—Mg and Ti—Mg of the 21-carat gold alloy respectively.

Typically, the gold is a 21-carat alloy having substantially higher springiness, luster and lower wear and has compatible color retention properties compared with conventional Gold alloy.

In a further embodiment of the present invention, the gold alloy is a whitish yellow 22-carat Gold alloy comprising:

91.6 to 92% by weight of gold,
0.01 to 1.5% by weight of zirconium,
0.01 to 1.5% by weight of titanium,
0 to 8.38% by weight of copper,
0 to 8.38% by weight of zinc, and
0 to 8.38% by weight of silver.

Typically, the gold alloy is a greenish yellow 22-carat Gold alloy comprising:

91.6 to 92% by weight of gold,
0.01 to 1.5% by weight of zirconium,
0.01 to 1.5% by weight of magnesium,
0 to 8.38% by weight of copper,
0 to 8.38% by weight of zinc, and
0 to 8.38% by weight of silver.

Typically, the gold alloy is a pale yellow 22-carat Gold alloy comprising:

91.6 to 92% by weight of gold,
0.01 to 1.5% by weight of magnesium,
0.01 to 1.5% by weight of titanium,
0 to 8.38% by weight of copper,
0 to 8.38% by weight of zinc, and
0 to 8.38% by weight of silver.

Typically, the gold alloy has a specific gravity in the range of 17 to 18 g/cc; preferably 17.40 g/cc, 17.14 g/cc and 17.08 g/cc for Zr—Ti, Zr—Mg and Ti—Mg of the 22-carat gold alloy respectively.

Typically, the gold alloy comprises a hardness in the range of 170 to 205 Vickers HV-0.05 ASM F 384-11, preferably 175-190, 190-205 and 170-195 Vickers HV-0.05 ASM F 384-11 for Zr—Ti, Zr—Mg and Ti—Mg of the 22-carat gold alloy respectively.

Typically, the gold is a 22-carat alloy having substantially higher springiness, luster and lower wear and has compatible color retention properties compared with conventional Gold alloy.

In a still further embodiment of the present invention, the gold alloy is a whitish yellow 23-carat Gold alloy comprising:

95.8 to 97% by weight of gold,
0.01 to 1.5% by weight of zirconium,
0.01 to 1.5% by weight of titanium,
0 to 4.18% by weight of copper,
0 to 4.18% by weight of zinc, and
0 to 4.18% by weight of silver.

Typically, the gold alloy is a greenish yellow 23-carat Gold alloy comprising:

95.8 to 97% by weight of gold,
0.01 to 1.5% by weight of zirconium,
0.01 to 1.5% by weight of magnesium,
0 to 4.18% by weight of copper,
0 to 4.18% by weight of zinc, and
0 to 4.18% by weight of silver.

Typically, the gold alloy is a pale yellow 23-carat Gold alloy comprising:

95.8 to 97% by weight of gold,
0.01 to 1.5% by weight of magnesium,
0.01 to 1.5% by weight of titanium,
0 to 4.18% by weight of copper,
0 to 4.18% by weight of zinc, and
0 to 4.18% by weight of silver.

Typically, the gold alloy has a specific gravity in the range of 17.5 to 18.5 g/cc; preferably 18.27 g/cc, 17.97 g/cc, 17.92 g/cc for Zr—Ti, Zr—Mg and Ti—Mg of the 23-carat gold alloy respectively.

Typically, the gold alloy comprises a hardness in the range of 125 to 155 Vickers HV-0.05 ASM F 384-11, preferably 145-155, 125-135 and 135-150 Vickers HV-0.05 ASM F 384-11 for Zr—Ti, Zr—Mg and Ti—Mg of the 23-carat gold alloy respectively.

Typically, the gold is a 23-carat (having Indian standard of 95.58 to 96% by weight of gold and Thailand standard of 96.15 to 96.55% by weight of gold) gold alloy having substantially higher springiness, luster and lower wear and has compatible color retention properties compared with conventional Gold alloy.

In a yet further embodiment of the present invention, the gold alloy is a whitish yellow 24-carat Gold alloy comprising:

97 to 99.5% by weight of gold,
0.01 to 1.5% by weight of zirconium, and
0.01 to 1.5% by weight of Titanium.

Typically, the gold alloy is a greenish yellow 24-carat Gold alloy comprising:

97 to 99.5% by weight of gold,
0.01 to 1.5% by weight of zirconium, and
0.01 to 1.5% by weight of Magnesium.

Typically, the gold alloy is a pale yellow 24-carat Gold alloy comprising:

97 to 99.5% by weight of gold, 0.01 to 1.5% by weight of magnesium, and 0.01 to 1.5% by weight of Titanium.

Typically, the gold alloy has a specific gravity in the range of 18.5 to 19.5 g/cc; preferably 19.05 g/cc, 18.73 g/cc, 18.67 g/cc for Zr—Ti, Zr—Mg and Ti—Mg of the 24-carat gold alloy respectively.

Typically, the gold alloy comprises a hardness in the range of 75 to 105 Vickers HV-0.05 ASM F 384-11, preferably 75-105, 80-95 and 75-100 Vickers HV-0.05 ASM F 384-11 for Zr—Ti, Zr—Mg and Ti—Mg of the 24-carat gold alloy respectively.

Typically, the Gold alloy is a 24-carat Gold (includes Hong Kong/China based Chuk Kam jewelry with 99.0 to 99.5% by weight of Gold) alloy having substantially higher springiness, luster and lower wear and compatible color retention properties compared to conventional Gold alloy.

Ranges for 2-Metal Combinations

| a- 18 carat | |
|---|---|
| i- Zirconium and Titanium | |
| Gold | 75-75.5% |
| Zirconium | 0.01 to 1.5% |
| Titanium | 0.01 to 1.5% |
| Copper | 0 to 24.98% |
| Zinc | 0 to 24.98% |
| Silver | 0 to 24.98% |
| ii-Zirconium and Magnesium | |
| Gold | 75-75.5% |
| Zirconium | 0.01 to 1.5% |
| Magnesium | 0.01 to 1.5% |
| Copper | 0 to 24.98% |
| Zinc | 0 to 24.98% |
| Silver | 0 to 24.98% |
| iii-Magnesium and Titanium | |
| Gold | 75-75.5% |
| Magnesium | 0.01 to 1.5% |
| Titanium | 0.01 to 1.5% |
| Copper | 0 to 24.8% |
| Zinc | 0 to 24.98% |
| Silver | 0 to 24.98% |
| b- 21 carat | |
| i- Zirconium and Titanium | |
| Gold | 87.5-88% |
| Zirconium | 0.01 to 1.5% |
| Titanium | 0.01 to 1.5% |
| Copper | 0 to 12.48% |
| Zinc | 0 to 12.48% |
| Silver | 0 to 12.48% |
| ii-Zirconium and Magnesium | |
| Gold | 87.5-88% |
| Zirconium | 0.01 to 1.5% |
| Magnesium | 0.01 to 1.5% |
| Copper | 0 to 12.48% |
| Zinc | 0 to 12.48% |
| Silver | 0 to 12.48% |
| iii-Magnesium and Titanium | |
| Gold | 87.5-88% |
| Magnesium | 0.01 to 1.5% |
| Titanium | 0.01 to 1.5% |
| Copper | 0 to 12.48% |
| Zinc | 0 to 12.48% |
| Silver | 0 to 12.48% |

-continued

| c- 22 carat | |
|---|---|
| i- Zirconium and Titanium | |
| Gold | 91.6-92% |
| Zirconium | 0.01 to 1.5% |
| Titanium | 0.01 to 1.5% |
| Copper | 0 to 8.38% |
| Zinc | 0 to 8.38% |
| Silver | 0 to 8.38% |
| ii-Zirconium and Magnesium | |
| Gold | 91.6-92% |
| Zirconium | 0.01 to 1.5% |
| Magnesium | 0.01 to 1.5% |
| Copper | 0 to 8.38% |
| Zinc | 0 to 8.38% |
| Silver | 0 to 8.38% |
| iii-Magnesium and Titanium | |
| Gold | 91.6-92% |
| Magnesium | 0.01 to 1.5% |
| Titanium | 0.01 to 1.5% |
| Copper | 0 to 8.38% |
| Zinc | 0 to 8.38% |
| Silver | 0 to 8.38% |
| d- 23 carat | |
| i- Zirconium and Titanium | |
| Gold | 95.8-97% |
| Zirconium | 0.01 to 1.5% |
| Titanium | 0.01 to 1.5% |
| Copper | 0 to 4.18% |
| Zinc | 0 to 4.18% |
| Silver | 0 to 4.18% |
| ii-Zirconium and Magnesium | |
| Gold | 95.8-97% |
| Zirconium | 0.01 to 1.5% |
| Magnesium | 0.01 to 1.5% |
| Copper | 0 to 4.18% |
| Zinc | 0 to 4.18% |
| Silver | 0 to 4.18% |
| iii-Magnesium and Titanium | |
| Gold | 95.8-97% |
| Magnesium | 0.01 to 1.5% |
| Titanium | 0.01 to 1.5% |
| Copper | 0 to 4.18% |
| Zinc | 0 to 4.18% |
| Silver | 0 to 4.18% |
| e- 24 carat | |
| i- Zirconium and Titanium | |
| Gold | 97-99.5% |
| Zirconium | 0.01 to 0.5% |
| Titanium | 0.01 to 0.5% |
| ii-Zirconium and Magnesium | |
| Gold | 97-99.5% |
| Zirconium | 0.01 to 0.5% |
| Magnesium | 0.01 to 0.5% |
| iii-Magnesium and Titanium | |
| Gold | 97-99.5% |
| Magnesium | 0.01 to 0.5% |
| Titanium | 0.01 to 0.5% |

Experimental Verification:

The following are the results of the test conducted for different caratage of the gold alloy made in accordance with the present invention:

A1—18-Carat Having Compositions

| |
|---|
| CONVENTIONAL ALLOY- |
| 75% BY WEIGHT OF GOLD<br>12.5% BY WEIGHT OF COPPER<br>12.5% BY WEIGHT OF SILVER |
| GOLD ALLOY ACCORDING TO THE PRESENT INVENTION: |
| 75% BY WEIGHT OF GOLD<br>0.10% BY WEIGHT OF ZIRCONIUM<br>0.10% BY WEIGHT OF MAGNESIUM<br>0.10% BY WEIGHT OF TITANIUM<br>12.35% BY WEIGHT OF COPPER<br>6.175% BY WEIGHT OF ZINC<br>6.175% BY WEIGHT OF SILVER |

Specific Gravity:

It has been tested and observed that the specific gravity of the 18-carat Gold alloy made according to the present invention is significantly reduced. While the conventional 18-carat gold has a specific gravity of 15.442 gm/cc, 18-carat gold alloy made in accordance with the present invention with the above composition has demonstrated a specific gravity of 14.67 gm/cc, which is 4.99% less than the conventional 18-carat gold alloy. This is a substantial cost-effectiveness for this high value metal used for jewelry manufacture.

Color Retention:

18-carat Gold alloy with the above composition made according to the present invention is also compatible in terms of the color retention properties thereof, when compared with conventional 18-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 18-carat Gold Alloy | | | | |
| 1 | | −85.82 | 60.98 | NA | 32.20 | 81.18 | 5.82 | 11.81 |
| | | −84.94 | 60.65 | NA | 32.44 | 81.4 | 5.5 | 11.42 |
| | | −85.31 | 60.45 | NA | 32.18 | 81.2 | 5.4 | 10.9 |
| | Average | −85.36 | 60.69 | NA | 32.27 | 81.26 | 5.57 | 11.37 |
| B) | | | | 18-carat gold alloy made in accordance with the present invention | | | | |
| 2 | | −83.1 | 56.92 | NA | 34.14 | 78.18 | 3.12 | 22.8 |
| | | −83.34 | 56.05 | NA | 35.24 | 78.24 | 3.11 | 22.14 |
| | | −83.8 | 56.45 | NA | 35.14 | 78.2 | 3.12 | 23.10 |
| | Average | −83.41 | 56.47 | NA | 34.84 | 78.2 | 3.11 | 22.68 |

Enhanced Hardness:

| | 18-carat Conventional Gold Alloy | 18-carat gold of the present invention |
|---|---|---|
| Work Hardened Hardness (Vickers HV-.05 ASM F 384-11) | Around 225 | 240-260 |

Springiness—Test Conducted by Compression Tester:

| | Springiness Observed in 18-carat Conventional Gold Alloy | Springiness Observed in 18-carat gold of the present invention |
|---|---|---|
| Round specimen used is a machine-made bangle as the final product. Size-52.5 mm Inner Diameter and Thickness 1.3 mm and 5.5 mm width | Up to appx. 2170 gm and deflection of 5.3 mm | Up to appx. 2310 gm and deflection of 5.9 mm |

Accordingly, from the above table, it is evident that the springiness witnessed in the gold alloy made in accordance with the present invention is substantially higher in comparison with the conventional 18-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 18-carat Gold Alloy) Test piece Size = 20 mm × 20 mm × 0.3 mm | 1.845 | 1.818 | 0.027 | 1.463 |
| 2 | (18-carat Gold alloy of present invention)) Test piece Size = 20 mm × 20 mm × 0.3 mm | 1.705 | 1.688 | .017 | .997 |

Experimental Verification:

The following are the results of the test conducted for 18 caratage of the gold alloy made in accordance with the present invention:

A2—18-Carat Having Compositions

| |
|---|
| CONVENTIONAL ALLOY- |
| 75% BY WEIGHT OF GOLD<br>12.5% BY WEIGHT OF COPPER<br>12.5% BY WEIGHT OF SILVER |
| GOLD ALLOY ACCORDING TO THE PRESENT INVENTION: |
| 75% BY WEIGHT OF GOLD<br>0.05% BY WEIGHT OF ZIRCONIUM<br>0.05% BY WEIGHT OF MAGNESIUM |

-continued

| |
|---|
| 12.45% BY WEIGHT OF COPPER |
| 6.225% BY WEIGHT OF ZINC |
| 6.225% BY WEIGHT OF SILVER |

Specific Gravity:

It has been tested and observed that the specific gravity of the 18-carat Gold alloy made according to the present invention is significantly reduced by the gold alloy made in accordance with the present invention. While the conventional 18-carat gold has a specific gravity of 15.442 gm/cc, 18-carat gold alloy made in accordance with the present invention with the above composition has demonstrated a specific gravity of 14.75 gm/cc, which is 4.49% lesser than the conventional 18-carat gold alloy. This is a substantial cost-effectiveness for this high value metal used for jewelry manufacture.

Color Retention:

18-carat Gold alloy with the above composition made according to the present invention is also compatible in terms of the color retention properties thereof, when compared with conventional 18-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 18-carat Gold Alloy | | | | |
| 1 | | −85.82 | 60.98 | NA | 32.20 | 81.18 | 5.82 | 11.81 |
| | | −84.94 | 60.65 | NA | 32.44 | 81.4 | 5.5 | 11.42 |
| | | −85.31 | 60.45 | NA | 32.18 | 81.2 | 5.4 | 10.9 |
| | Average | −85.36 | 60.69 | NA | 32.27 | 81.26 | 5.57 | 11.37 |
| B) | | | | 18-carat gold alloy made in accordance with the present invention | | | | |
| 2 | | −80.1 | 57.92 | NA | 31.58 | 78.14 | 3.0 | 20.8 |
| | | −79.34 | 58.15 | NA | 30.98 | 77.92 | 2.98 | 21.6 |
| | | −78.24 | 56.45 | NA | 31.45 | 78.21 | 2.9 | 21.3 |
| | Average | −79.22 | 57.50 | NA | 31.33 | 78.09 | 2.96 | 21.23 |

Enhanced Hardness:

| | 18-carat Conventional Gold Alloy | 18-carat gold of the present invention |
|---|---|---|
| Work Hardened Hardness (Vickers HV-.05 ASM F 384-11) | Around 225 | 235-255 |

Springiness—Test Conducted by Compression Tester:

| | Springiness Observed in 18-carat Conventional Gold Alloy | Springiness Observed in 18-carat gold of the present invention |
|---|---|---|
| Round specimen used is a machine-made bangle as the final product. Size-52.5 mm Inner Diameter and Thickness 1.3 mm and 5.5 mm width | Up to appx. 2170 gm and deflection of 5.3 mm | Up to appx. 2205 gm and deflection of 5.4 mm |

Accordingly, from the above table, it is evident that the springiness witnessed in the gold alloy made in accordance with the present invention is substantially higher in comparison with the conventional 18-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 18-carat Gold Alloy) Test piece Size = 20 mm × 20 mm × 0.3 mm | 1.845 | 1.818 | 0.027 | 1.463 |
| 2 | (18-carat Gold alloy) Test piece Size = 20 mm × 20 mm × 0.3 mm | 1.765 | 1.746 | .019 | 1.07 |

A3—18-Carat Having Compositions

| CONVENTIONAL ALLOY- |
|---|
| 75% BY WEIGHT OF GOLD |
| 12.5% BY WEIGHT OF COPPER |
| 12.5% BY WEIGHT OF SILVER |
| GOLD ALLOY ACCORDING TO THE PRESENT INVENTION: |
| 75% BY WEIGHT OF GOLD |
| 0.05% BY WEIGHT OF TITANIUM |
| 0.05% BY WEIGHT OF MAGNESIUM |
| 12.45% BY WEIGHT OF COPPER |
| 6.225% BY WEIGHT OF ZINC |
| 6.225% BY WEIGHT OF SILVER |

Specific Gravity:

It has been tested and observed that the specific gravity of the 18-carat Gold alloy made according to the present invention is significantly reduced by the gold alloy made in accordance with the present invention. While the conventional 18-carat gold has a specific gravity of 15.442 gm/cc, 18-carat gold alloy made in accordance with the present invention with the above composition has demonstrated a specific gravity of 14.74 gm/cc, which is 4.54% lesser than the conventional 18-carat gold alloy. This is a substantial cost-effectiveness for this high value metal used for jewelry manufacture.

Color Retention:

18-carat Gold alloy with the above composition made according to the present invention is also compatible in terms of the color retention properties thereof when compared with conventional 18-carat Gold alloys as observed under (CIE Defined) color spectrograph.

Size of test pieces 21 mm×21 mm×0.32 mm:

| No. | Side | WI-CIE (Whiteness) | YI-E313 (Yellowness) | Opacity | TB-452 (Brightness) | Coordinate L* | Coordinate a* | Coordinate b* |
|---|---|---|---|---|---|---|---|---|
| A) | | | | Conventional 18-carat Gold Alloy | | | | |
| 1 | | −85.82 | 60.98 | NA | 32.20 | 81.18 | 5.82 | 11.81 |
| | | −84.94 | 60.65 | NA | 32.44 | 81.4 | 5.5 | 11.42 |
| | | −85.31 | 60.45 | NA | 32.18 | 81.2 | 5.4 | 10.9 |
| | Average | −85.36 | 60.69 | NA | 32.27 | 81.26 | 5.57 | 11.37 |
| B) | | | | 18-carat gold alloy made in accordance with the present invention | | | | |
| 2 | | −78.24 | 55.98 | NA | 30.98 | 81.4 | 2.75 | 15.58 |
| | | −78.54 | 56.02 | NA | 30.9 | 80.12 | 2.55 | 16.78 |
| | | −78.48 | 56.04 | NA | 31.0 | 81.55 | 2.69 | 16.45 |
| | Average | −78.42 | 56.01 | NA | 30.96 | 80.02 | 2.66 | 16.27 |

Enhanced Hardness:

| | 18-carat Conventional Gold Alloy | 18-carat gold of the present invention |
|---|---|---|
| Work Hardened Hardness (Vickers HV-.05 ASM F 384-11) | Around 225 | 245-255 |

Springiness—Test Conducted by Compression Tester:

| | Springiness Observed in 18-carat Conventional Gold Alloy | Springiness Observed in 18-carat gold of the present invention |
|---|---|---|
| Round specimen used is a machine-made bangle as the final product. Size-52.5 mm Inner Diameter and Thickness 1.3 mm and 5.5 mm width | Up to appx. 2170 gm and deflection of 5.3 mm | Up to appx. 2190 gm and deflection of 5.4 mm |

Accordingly, from the above table, it is evident that the springiness witnessed in the gold alloy made in accordance with the present invention is substantially higher in comparison with the conventional 18-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 18-carat Gold Alloy) Test piece Size = 20 mm × 20 mm × 0.3 mm | 1.845 | 1.818 | 0.027 | 1.463 |

-continued

Wear Resistance Test

| No. | Gold Alloy | Weight Before Test gm | Weight After Test gm | Weight Loss gm | % Loss |
|---|---|---|---|---|---|
| 2 | (18-carat Gold alloy) Test piece Size = 20 mm × 20 mm × 0.3 mm | 1.768 | 1.751 | .017 | .9615 |

A4—18-Carat Having Compositions

| CONVENTIONAL ALLOY- |
|---|
| 75% BY WEIGHT OF GOLD |
| 12.5% BY WEIGHT OF COPPER |
| 12.5% BY WEIGHT OF SILVER |
| GOLD ALLOY ACCORDING TO THE PRESENT INVENTION- |
| 75% BY WEIGHT OF GOLD |
| 0.05% BY WEIGHT OF TITANIUM |
| 0.05% BY WEIGHT OF ZIRCONIUM |
| 12.45% BY WEIGHT OF COPPER |
| 6.225% BY WEIGHT OF ZINC |
| 6.225% BY WEIGHT OF SILVER |

Specific Gravity:

It has been tested and observed that the specific gravity of the 18-carat Gold alloy made according to the present invention is significantly reduced by the gold alloy made in accordance with the present invention. While the conventional 18-carat gold has a specific gravity of 15.442 gm/cc, 18-carat gold alloy made in accordance with the present invention with the above composition has demonstrated a specific gravity of 14.78 gm/cc, which is 4.24% lesser than the conventional 18-carat gold alloy. This is a substantial cost-effectiveness for this high value metal used for jewelry manufacture.

Color Retention:

18-carat Gold alloy with the above composition made according to the present invention is also compatible in terms of the color retention properties thereof when compared with conventional 18-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 18-carat Gold Alloy | | | | |
| 1 | | −85.82 | 60.98 | NA | 32.20 | 81.18 | 5.82 | 11.81 |
| | | −84.94 | 60.65 | NA | 32.44 | 81.4 | 5.5 | 11.42 |
| | | −85.31 | 60.45 | NA | 32.18 | 81.2 | 5.4 | 10.9 |
| | Average | −85.36 | 60.69 | NA | 32.27 | 81.26 | 5.57 | 11.37 |
| B) | | | | 18-carat gold alloy made in accordance with the present invention | | | | |
| 2 | | −72.15 | 54.01 | NA | 32.58 | 84.75 | 5.0 | 14.21 |
| | | −73.05 | 54.01 | NA | 33.0 | 85.12 | 2.85 | 13.9 |
| | | −73.45 | 54.45 | NA | 33.25 | 85.23 | 3.9 | 13.58 |
| | Average | −72.88 | 54.15 | NA | 32.94 | 85.03 | 3.91 | 13.89 |

Enhanced Hardness:

| | 18-carat Conventional Gold Alloy | 18-carat gold of the present invention |
|---|---|---|
| Work Hardened Hardness (Vickers HV-.05 ASM F 384-11) | Around 225 | 245-265 |

Springiness—Test Conducted by Compression Tester:

| | Springiness Observed in 18-carat Conventional Gold Alloy | Springiness Observed in 18-carat gold of the present invention |
|---|---|---|
| Round specimen used is a machine-made bangle as the final product. Size-52.5 mm Inner Diameter and Thickness 1.3 mm and 5.5 mm width | Up to appx. 2170 gm and deflection of 5.3 mm | Up to appx. 2175 gm and deflection of 5.3 mm |

Accordingly, from the above table, it is evident that the springiness witnessed in the gold alloy made in accordance with the present invention is substantially higher in comparison with the conventional 18-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 18-carat Gold Alloy) Test piece Size = 20 mm × 20 mm × 0.3 mm | 1.845 | 1.818 | 0.027 | 1.463 |

-continued

Wear Resistance Test

| No. | Gold Alloy | Weight Before Test gm | Weight After Test gm | Weight Loss gm | % Loss |
|---|---|---|---|---|---|
| 2 | (18-carat Gold alloy) Test piece Size = 20 mm × 20 mm × 0.3 mm | 1.774 | 1.756 | .018 | 1.01 |

B1—21-Carat Having Compositions

| CONVENTIONAL ALLOY- |
|---|
| 87.5% BY WEIGHT OF GOLD<br>9.37% BY WEIGHT OF COPPER<br>3.13% BY WEIGHT OF SILVER |
| GOLD ALLOY ACCORDING TO THE PRESENT INVENTION- |
| 87.5% BY WEIGHT OF GOLD<br>0.15% BY WEIGHT OF ZIRCONIUM<br>0.15% BY WEIGHT OF MAGNESIUM<br>0.15% BY WEIGHT OF TITANIUM<br>6.025% BY WEIGHT OF COPPER<br>3.0125% BY WEIGHT OF ZINC<br>3.0125% BY WEIGHT OF SILVER |

Specific Gravity:

It has been tested and observed that the specific gravity of the 21-carat Gold alloy made according to the present invention is significantly reduced. While the conventional 21-carat gold has a specific gravity of 17.006 gm/cc, 21-carat gold alloy made in accordance with the present invention with the above composition has demonstrated a specific gravity of 16.502 gm/cc, which is 2.96% less than the conventional 21-carat gold alloy. This is a substantial cost-effectiveness for this high value metal used for jewelry manufacture.

Color Retention:

21-carat Gold alloy with the above composition made according to the present invention is also compatible in terms of the color retention properties thereof when compared with conventional 21-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 21-carat Gold Alloy | | | | |
| 1 | | −94.68 | 65.98 | NA | 29.46 | 82.29 | 7.86 | 13.87 |
| | | −94.77 | 66.01 | NA | 29.44 | 82.3 | 7.86 | 13.9 |
| | | −94.86 | 66.32 | NA | 29.56 | 82.28 | 7.83 | 13.86 |
| | Average | −94.77 | 66.1 | NA | 29.49 | 82.29 | 7.86 | 13.88 |
| B) | | | | 21-carat gold alloy made in accordance with the present invention | | | | |
| 2 | | −92.8 | 57.92 | NA | 32.74 | 80.02 | 3.57 | 28.72 |
| | | −92.83 | 57.94 | NA | 32.73 | 79.98 | 3.8 | 30.28 |
| | | −92.97 | 57.96 | NA | 32.72 | 79.96 | 3.82 | 30.23 |
| | Average | −92.87 | 57.94 | NA | 32.73 | 79.99 | 3.73 | 29.74 |

Enhanced Hardness:

| | 21-carat Conventional Gold Alloy | 21-carat gold of the present invention |
|---|---|---|
| Work Hardened Hardness (Vickers HV-.05 ASM F 384-11) | Around 190 | 200-225 |

Springiness—Test Conducted by Compression Tester:

| | Springiness Observed in 21-carat Conventional Gold Alloy | Springiness Observed in 21-carat gold of the present invention |
|---|---|---|
| Round specimen used is a machine-made bangle as the final product. Size-52.5 mm Inner Diameter and Thickness 1.3 mm and 5.5 mm width | Up to appx. 1760 gm and deflection of 4.7 mm | Up to appx. 1945 gm and deflection of 5.2 mm |

Accordingly, from the above table, it is evident that the springiness witnessed in the gold alloy made in accordance with the present invention is substantially higher in comparison with the conventional 21-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 21-carat Gold Alloy) Test piece Size = 20 mm × 20 mm × 0.3 mm | 2.04 | 1.999 | 0.041 | 2.009 |
| 2 | (21-carat Gold alloy of present Invention) Test piece Size = 20 mm × 20 mm × 0.3 mm | 1.937 | 1.903 | .034 | 1.755 |

B2—21-Carat Having Compositions

| CONVENTIONAL ALLOY- |
|---|
| 87.5% BY WEIGHT OF GOLD |
| 9.37% BY WEIGHT OF COPPER |
| 3.13% BY WEIGHT OF SILVER |
| GOLD ALLOY ACCORDING TO THE PRESENT INVENTION- |
| 87.5% BY WEIGHT OF GOLD |
| 0.15% BY WEIGHT OF ZIRCONIUM |
| 0.15% BY WEIGHT OF TITANIUM |
| 6.1% BY WEIGHT OF COPPER |
| 3.05% BY WEIGHT OF ZINK |
| 3.05% BY WEIGHT OF SILVER |

Specific Gravity:

It has been tested and observed that the specific gravity of the 21-carat Gold alloy made according to the present invention is significantly reduced. While the conventional 21-carat gold has a specific gravity of 17.006 gm/cc, 21-carat gold alloy made in accordance with the present invention with the above composition has demonstrated a specific gravity of 16.69 gm/cc, which is 1.84% lesser than the conventional 21-carat gold alloy. This is a substantial cost-effectiveness for this high value metal used for jewelry manufacture.

Color Retention:

21-carat Gold alloy with the above composition made according to the present invention is also compatible in terms of the color retention properties thereof when compared with conventional 21-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 21-carat Gold Alloy | | | | |
| 1 | | −94.68 | 65.98 | NA | 29.46 | 82.29 | 7.86 | 13.87 |
| | | −94.77 | 66.01 | NA | 29.44 | 82.3 | 7.86 | 13.9 |
| | | −94.86 | 66.32 | NA | 29.56 | 82.28 | 7.83 | 13.86 |
| | Average | −94.77 | 66.1 | NA | 29.49 | 82.29 | 7.86 | 13.88 |
| B) | | | | 21-carat gold alloy made in accordance with the present invention | | | | |
| 2 | | −90.6 | 55.98 | NA | 34.74 | 79.98 | 2.96 | 15.24 |
| | | −90.52 | 55.90 | NA | 35.05 | 80.02 | 4.01 | 18.37 |
| | | −90.47 | 55.05 | NA | 35.00 | 79.96 | 3.86 | 19.0 |
| | Average | −90.53 | 55.65 | NA | 34.93 | 79.99 | 3.61 | 17.7 |

Enhanced Hardness:

| | 21-carat Conventional Gold Alloy | 21-carat gold of the present invention |
|---|---|---|
| Work Hardened Hardness (Vickers HV-.05 ASM F 384-11) | Around 190 | 205-230 |

Springiness—Test Conducted by Compression Tester:

| | Springiness Observed in 21-carat Conventional Gold Alloy | Springiness Observed in 21-carat gold of the present invention |
|---|---|---|
| Round specimen used is a machine-made bangle as the final product. Size-52.5 mm Inner Diameter and Thickness 1.3 mm and 5.5 mm width | Up to appx. 1760 gm and deflection of 4.7 mm | Up to appx. 1800 gm and deflection of 4.95 mm |

Accordingly, from the above table, it is evident that the springiness witnessed in the gold alloy made in accordance with the present invention is substantially higher in comparison with the conventional 21-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 21-carat Gold Alloy) Test piece Size = 20 mm × 20 mm × 0.3 mm | 2.04 | 1.999 | 0.041 | 2.009 |

-continued

Wear Resistance Test

| No. | Gold Alloy | Weight Before Test gm | Weight After Test gm | Weight Loss gm | % Loss |
|---|---|---|---|---|---|
| 2 | (21-carat Gold alloy of present Invention) Test piece Size = 20 mm × 20 mm × 0.3 mm | 2.00 | 1.971 | .029 | 1.45 |

B3—21-Carat Having Compositions

| CONVENTIONAL ALLOY- |
|---|
| 87.5% BY WEIGHT OF GOLD |
| 9.37% BY WEIGHT OF COPPER |
| 3.13% BY WEIGHT OF SILVER |
| GOLD ALLOY ACCORDING TO THE PRESENT INVENTION- |
| 87.5% BY WEIGHT OF GOLD |
| 0.15% BY WEIGHT OF ZIRCONIUM |
| 0.15% BY WEIGHT OF MAGNESIUM |
| 6.1% BY WEIGHT OF COPPER |
| 3.05% BY WEIGHT OF ZINK |
| 3.05% BY WEIGHT OF SILVER |

Specific Gravity:

It has been tested and observed that the specific gravity of 21-carat Gold alloy made according to the present invention is significantly reduced. While conventional 21-carat gold has a specific gravity of 17.006 gm/cc, 21-carat gold alloy made in accordance with the present invention with the above composition has demonstrated a specific gravity of 16.55 gm/cc, which is 2.7% lesser than the conventional 21-carat gold alloy. This is a substantial cost-effectiveness for this high value metal used for jewelry manufacture.

Color Retention:

21-carat Gold alloy with the above composition made according to the present invention is also compatible in terms of the color retention properties thereof when compared with conventional 21-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 21-carat Gold Alloy | | | | |
| 1 | | −94.68 | 65.98 | NA | 29.46 | 82.29 | 7.86 | 13.87 |
| | | −94.77 | 66.01 | NA | 29.44 | 82.3 | 7.86 | 13.9 |

-continued

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| | | −94.86 | 66.32 | NA | 29.56 | 82.28 | 7.83 | 13.86 |
| | Average | −94.77 | 66.1 | NA | 29.49 | 82.29 | 7.86 | 13.88 |
| B) | | 21-carat gold alloy made in accordance with the present invention | | | | | | |
| 2 | | −91.38 | 56.07 | NA | 32.33 | 80.04 | 2.05 | 18.23 |
| | | −91.89 | 56.02 | NA | 32.55 | 81.14 | 1.95 | 17.67 |
| | | −91.59 | 56.02 | NA | 32.0 | 81.23 | 1.80 | 17.51 |
| | Average | −91.62 | 56.03 | NA | 32.63 | 80.80 | 1.93 | 17.79 |

Enhanced Hardness:

| | 21-carat Conventional Gold Alloy | 21-carat gold of the present invention |
|---|---|---|
| Work Hardened Hardness (Vickers HV-.05 ASM F 384-11) | Around 190 | 200-210 |

Springiness—Test Conducted by Compression Tester:

| | Springiness Observed in 21-carat Conventional Gold Alloy | Springiness Observed in 21-carat gold of the present invention |
|---|---|---|
| Round specimen used is a machine-made bangle as the final product. Size-52.5 mm Inner Diameter and Thickness 1.3 mm and 5.5 mm width | Up to appx. 1760 gm and deflection of 4.7 mm | Up to appx. 1950 gm and deflection of 5.3 mm |

Accordingly, from the above table, it is evident that the springiness witnessed in the gold alloy made in accordance with the present invention is substantially higher in comparison with the conventional 21-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 21-carat Gold Alloy) Test piece Size = 20 mm × 20 mm × 0.3 mm | 2.04 | 1.999 | 0.041 | 2.009 |
| 2 | (21-carat Gold alloy of present Invention) | 1.986 | 1.951 | .034 | 1.72 |

-continued

Wear Resistance Test

| No. | Gold Alloy | Weight Before Test gm | Weight After Test gm | Weight Loss gm | % Loss |
|---|---|---|---|---|---|
| | Test piece Size = 20 mm × 20 mm × 0.3 mm | | | | |

B4—21-Carat Having Compositions

| CONVENTIONAL ALLOY- |
|---|
| 87.5% BY WEIGHT OF GOLD<br>9.37% BY WEIGHT OF COPPER<br>3.13% BY WEIGHT OF SILVER |
| GOLD ALLOY ACCORDING TO THE PRESENT INVENTION- |
| 87.5% BY WEIGHT OF GOLD<br>0.15% BY WEIGHT OF TITANIUM<br>0.15% BY WEIGHT OF MAGNESIUM<br>6.1% BY WEIGHT OF COPPER<br>3.05% BY WEIGHT OF ZINK<br>3.05% BY WEIGHT OF SILVER |

Specific Gravity:

It has been tested and observed that the specific gravity of the 21-carat Gold alloy made according to the present invention is significantly reduced. While the conventional 21-carat gold has a specific gravity of 17.006 gm/cc, 21-carat gold alloy made in accordance with the present invention with the above composition has demonstrated a specific gravity of 16.51 gm/cc, which is 2.87% lesser than the conventional 21-carat gold alloy. This is a substantial cost-effectiveness for this high value metal used for jewelry manufacture.

Color Retention:

21-carat Gold alloy with the above composition made according to the present invention is also compatible in terms of the color retention properties thereof, when compared with conventional 21-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | Conventional 21-carat Gold Alloy | | | | | | |
| 1 | | −94.68 | 65.98 | NA | 29.46 | 82.29 | 7.86 | 13.87 |
| | | −94.77 | 66.01 | NA | 29.44 | 82.3 | 7.86 | 13.9 |
| | | −94.86 | 66.32 | NA | 29.56 | 82.28 | 7.83 | 13.86 |
| | Average | −94.77 | 66.1 | NA | 29.49 | 82.29 | 7.86 | 13.88 |

-continued

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| B) | | 21-carat gold alloy made in accordance with the present invention | | | | | | |
| 2 | | −90.99 | 56.99 | NA | 35.01 | 84.01 | 2.95 | 12.89 |
| | | −91.02 | 57.02 | NA | 36.02 | 84.37 | 2.95 | 13.37 |
| | | −91.12 | 57.12 | NA | 34.94 | 84.67 | 2.88 | 13.02 |
| | Average | −91.04 | 57.04 | NA | 35.34 | 84.35 | 2.92 | 13.09 |

Enhanced Hardness:

| | 21-carat Conventional Gold Alloy | 21-carat gold of the present invention |
|---|---|---|
| Work Hardened Hardness (Vickers HV-.05 ASM F 384-11) | Around 190 | 200-225 |

Springiness—Test Conducted by Compression Tester:

| | Springiness Observed in 21-carat Conventional Gold Alloy | Springiness Observed in 21-carat gold of the present invention |
|---|---|---|
| Round specimen used is a machine-made bangle as the final product. Size-52.5 mm Inner Diameter and Thickness 1.3 mm and 5.5 mm width | Up to appx. 1760 gm and deflection of 4.7 mm | Up to appx. 1865 gm and deflection of 5.0 mm |

Accordingly, from the above table, it is evident that the springiness witnessed in the gold alloy made in accordance with the present invention is substantially higher in comparison with the conventional 21-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 21-carat Gold Alloy) Test piece Size = 20 mm × 20 mm × 0.3 mm | 2.04 | 1.999 | 0.041 | 2.009 |

-continued

Wear Resistance Test

| No. | Gold Alloy | Weight Before Test gm | Weight After Test gm | Weight Loss gm | % Loss |
|---|---|---|---|---|---|
| 2 | (21-carat Gold alloy of present Invention) Test piece Size = 20 mm × 20 mm × 0.3 mm | 1.980 | 1.95 | .030 | 1.52 |

C1—22-Carat Having Compositions

| CONVENTIONAL ALLOY- |
|---|
| 91.6% BY WEIGHT OF GOLD |
| 6.3% BY WEIGHT OF COPPER |
| 2.1% BY WEIGHT OF SILVER |
| GOLD ALLOY ACCORDING TO THE PRESENT INVENTION - |
| 91.6% BY WEIGHT OF GOLD |
| 0.25% BY WEIGHT OF ZIRCONIUM |
| 0.25% BY WEIGHT OF MAGNESIUM |
| 0.25% BY WEIGHT OF TITANIUM |
| 3.825% BY WEIGHT OF COPPER |
| 1.913% BY WEIGHT OF ZINC |
| 1.913% BY WEIGHT OF SILVER |

Specific Gravity:

It has been tested and observed that the specific gravity of the 22-carat Gold alloy made according to the present invention is significantly reduced by the above composition. the conventional 22-carat gold has a specific gravity of 17.696 gm/cc, 22-carat gold alloy made in accordance with the present invention has demonstrated a specific gravity of 17.057 gm/cc, which is 3.61% lesser than the conventional 22-carat gold alloy. This is a substantial cost-effectiveness for this high value metal used for jewelry manufacture.

Color Retention:

22-carat Gold alloy according to the present invention is also compatible in terms of the color retention properties thereof when compared with conventional 22-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | Conventional 22-carat Gold Alloy | | | | | | |
| 1 | | −117.67 | 70.11 | NA | 25.11 | 78.34 | 10.28 | 33.06 |
| | | −118.01 | 70.27 | NA | 25.12 | 78.33 | 10.35 | 33.05 |
| | | −117.81 | 70.22 | NA | 25.14 | 75.64 | 9.85 | 31.95 |
| | Average | −117.81 | 70.20 | NA | 25.12 | 77.44 | 10.16 | 32.69 |

-continued

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| B) | | 22-carat gold alloy made in accordance with the present invention | | | | | | |
| 2 | | −116.13 | 69.2 | NA | 28.43 | 82.12 | 6.76 | 30.37 |
| | | −119.3 | 69.24 | NA | 27.47 | 82.15 | 6.77 | 30.35 |
| | | −119.73 | 69.41 | NA | 28.19 | 82.14 | 6.75 | 30.43 |
| | Average | −117.39 | 69.28 | NA | 28.03 | 82.14 | 6.76 | 30.38 |

Enhanced Hardness:

| | 22-carat Conventional Gold Alloy | 22-carat gold of the present invention |
|---|---|---|
| Work Hardened Hardness (Vickers HV-.05 ASM F 384-11) | Around 140 | 170-195 |

Springiness—Test Conducted by Compression Tester:

| | Springiness Observed in 22-carat Conventional Gold Alloy | Springiness Observed in 22-carat Gold Alloy of the present invention |
|---|---|---|
| Round specimen used is a bangle as the final product. Size-52.5 mm Inner Diameter and Thickness 0.8 to 0.85 mm | Up to appx. 800 gm and deflection of 3.5 mm | Up to appx. 1320 gm and deflection of 4.7 mm |

Accordingly, from the above table, it is evident that the springiness witnessed in the gold alloy made in accordance with the present invention is substantially higher than the conventional 22-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 22-carat Gold Alloy) Test piece Size 20 mm × 20 mm × 0.3 mm | 2.12 | 2.024 | 0.096 | 4.528 |

-continued

Wear Resistance Test

| No. | Gold Alloy | Weight Before Test gm | Weight After Test gm | Weight Loss gm | % Loss |
|---|---|---|---|---|---|
| 2 | (22-carat Gold alloy of the present invention) Test piece Size 20 mm × 20 mm × 0.3 mm | 2.017 | 1.991 | 0.026 | 1.289 |

C2—22-Carat Having Compositions

| | |
|---|---|
| CONVENTIONAL ALLOY- | 91.6% BY WEIGHT OF GOLD<br>6.3% BY WEIGHT OF COPPER<br>2.1% BY WEIGHT OF SILVER |
| GOLD ALLOY ACCORDING TO THE PRESENT INVENTION - | 91.6% BY WEIGHT OF GOLD<br>0.25% BY WEIGHT OF ZIRCONIUM<br>0.25% BY WEIGHT OF MAGNESIUM<br>3.95% BY WEIGHT OF COPPER<br>1.975% BY WEIGHT OF ZINC<br>1.975% BY WEIGHT OF SILVER |

Specific Gravity:

It has been tested and observed that the specific gravity of the 22-carat Gold alloy made according to the present invention is significantly reduced by the above composition. the conventional 22-carat gold has a specific gravity of 17.696 gm/cc, 22-carat gold alloy made in accordance with the present invention has demonstrated a specific gravity of 17.14 gm/cc, which is 3.16% lesser than the conventional 22-carat gold alloy. This is a substantial cost-effectiveness for this high value metal used for jewelry manufacture.

Color Retention:

22-carat Gold alloy according to the present invention is also compatible in terms of the color retention properties thereof when compared with conventional 22-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | Conventional 22-carat Gold Alloy | | | | | | |
| 1 | | −117.6 7 | 70.11 | NA | 25.11 | 78.34 | 10.28 | 33.06 |
| | | −118.01 | 70.27 | NA | 25.12 | 78.33 | 10.35 | 33.05 |
| | | −117.81 | 70.22 | NA | 25.14 | 75.64 | 9.85 | 31.95 |
| | Average | −117.81 | 70.20 | NA | 25.12 | 77.44 | 10.16 | 32.69 |
| B) | | 22-carat gold alloy made in accordance with the present invention | | | | | | |
| 2 | | −117.0 | 68.45 | NA | 28.43 | 82.1 | 5.76 | 28.5 |
| | | −116.58 | 68.25 | NA | 27.47 | 82.05 | 5.91 | 28.69 |
| | | −118.23 | 68.25 | NA | 28.19 | 82.09 | 5.88 | 28.7 |
| | Average | −117.27 | 68.31 | NA | 28.03 | 82.08 | 5.85 | 28.63 |

Enhanced Hardness:

| | 22-carat Conventional Gold Alloy | 22-carat gold of the present invention |
|---|---|---|
| Work Hardened Hardness (Vickers HV-.05 ASM F 384-11) | Around 140 | 190-205 |

Springiness—Test Conducted by Compression Tester:

| | Springiness Observed in 22-carat Conventional Gold Alloy | Springiness Observed in 22-carat Gold Alloy of the present invention |
|---|---|---|
| Round specimen used is a bangle as the final product. Size-52.5 mm Inner Diameter and Thickness 0.8 to 0.85 mm | Up to appx. 800 gm and deflection of 3.5 mm | Up to appx. 1275 gm and deflection of 4.45 mm |

Accordingly, from the above table, it is evident that the springiness witnessed in the gold alloy made in accordance with the present invention is substantially higher than the conventional 22-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 22-carat Gold Alloy) Test piece Size 20 mm × 20 mm × 0.3 mm | 2.12 | 2.024 | 0.096 | 4.528 |
| 2 | (22-carat Gold alloy of the present invention) | 2.057 | 2.018 | 0.039 | 1.895 |

-continued

Wear Resistance Test

| No. | Gold Alloy | Weight Before Test gm | Weight After Test gm | Weight Loss gm | % Loss |
|---|---|---|---|---|---|
| | Test piece Size 20 mm × 20 mm × 0.3 mm | | | | |

C3—22-Carat Having Compositions

| | |
|---|---|
| CONVENTIONAL ALLOY- | 91.6% BY WEIGHT OF GOLD<br>6.3% BY WEIGHT OF COPPER<br>2.1% BY WEIGHT OF SILVER |
| GOLD ALLOY ACCORDING TO THE PRESENT INVENTION - | 91.6% BY WEIGHT OF GOLD<br>0.25% BY WEIGHT OF TITANIUM<br>0.25% BY WEIGHT OF MAGNESIUM<br>3.95% BY WEIGHT OF COPPER<br>1.975% BY WEIGHT OF ZINK<br>1.975% BY WEIGHT OF SILVER |

Specific Gravity:

It has been tested and observed that the specific gravity of the 22-carat Gold alloy made according to the present invention is significantly reduced by the above composition. the conventional 22-carat gold has a specific gravity of 17.696 gm/cc, 22-carat gold alloy made in accordance with the present invention has demonstrated a specific gravity of 17.08 gm/cc, which is 3.45% lesser than the conventional 22-carat gold alloy. This is a substantial cost-effectiveness for this high value metal used for jewelry manufacture.

Color Retention:

22-carat Gold alloy according to the present invention is also compatible in terms of the color retention properties thereof, when compared with conventional 22-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 22-carat Gold Alloy | | | | |
| 1 | | −117.67 | 70.11 | NA | 25.11 | 78.34 | 10.28 | 33.06 |
| | | −118.01 | 70.27 | NA | 25.12 | 78.33 | 10.35 | 33.05 |
| | | −117.81 | 70.22 | NA | 25.14 | 75.64 | 9.85 | 31.95 |
| | Average | −117.81 | 70.20 | NA | 25.12 | 77.44 | 10.16 | 32.69 |
| B) | | | | 22-carat gold alloy made in accordance with the present invention | | | | |
| 2 | | −115.2 | 67.21 | NA | 30.05 | 84.05 | 6.94 | 26.05 |
| | | −116.38 | 68.05 | NA | 31.5 | 84.0 | 6.82 | 26.0 |
| | | −115.1 | 67.8 | NA | 31.8 | 84.05 | 6.74 | 25.95 |
| | Average | −115.56 | 67.68 | NA | 31.12 | 84.02 | 6.82 | 26 |

Enhanced Hardness:

| | 22-carat Conventional Gold Alloy | 22-carat gold of the present invention |
|---|---|---|
| Work Hardened Hardness (Vickers HV-.05 ASM F 384-11) | Around 140 | 170-195 |

Springiness—Test Conducted by Compression Tester:

| | Springiness Observed in 22-carat Conventional Gold Alloy | Springiness Observed in 22-carat Gold Alloy of the present invention |
|---|---|---|
| Round specimen used is a bangle as the final product. Size-52.5 mm Inner Diameter and Thickness 0.8 to 0.85 mm | Up to appx. 800 gm and deflection of 3.5 mm | Up to appx. 1200 gm and deflection of 4.20 mm |

Accordingly, from the above table, it is evident that the springiness witnessed in the gold alloy made in accordance with the present invention is substantially higher than the conventional 22-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 22-carat Gold Alloy) Test piece Size 20 mm × 20 mm × 0.3 mm | 2.12 | 2.024 | 0.096 | 4.528 |
| 2 | (22-carat Gold alloy of the present invention) | 2.050 | 2.019 | 0.031 | 1.512 |

-continued

Wear Resistance Test

| No. | Gold Alloy | Weight Before Test gm | Weight After Test gm | Weight Loss gm | % Loss |
|---|---|---|---|---|---|
| | Test piece Size 20 mm × 20 mm × 0.3 mm | | | | |

C4—22-Carat Having Compositions

| | |
|---|---|
| CONVENTIONAL ALLOY- | 91.6% BY WEIGHT OF GOLD<br>6.3% BY WEIGHT OF COPPER<br>2.1% BY WEIGHT OF SILVER |
| GOLD ALLOY ACCORDING TO THE PRESENT INVENTION - | 91.6% BY WEIGHT OF GOLD<br>0.25% BY WEIGHT OF TITANIUM<br>0.25% BY WEIGHT OF ZIRCONIUM<br>3.95% BY WEIGHT OF COPPER<br>1.975% BY WEIGHT OF ZINK<br>1.975% BY WEIGHT OF SILVER |

Specific Gravity:

It has been tested and observed that the specific gravity of the 22-carat Gold alloy made according to the present invention is significantly reduced by the above composition. the conventional 22-carat gold has a specific gravity of 17.696 gm/cc, 22-carat gold alloy made in accordance with the present invention has demonstrated a specific gravity of 17.40 gm/cc, which is 1.67% lesser than the conventional 22-carat gold alloy. This is a substantial cost-effectiveness for this high value metal used for jewelry manufacture.

Color Retention:

22-carat Gold alloy according to the present invention is also compatible in terms of the color retention properties thereof when compared with conventional 22-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 22-carat Gold Alloy | | | | |
| 1 | | −117.67 | 70.11 | NA | 25.11 | 78.34 | 10.28 | 33.06 |
| | | −118.01 | 70.27 | NA | 25.12 | 78.33 | 10.35 | 33.05 |
| | | −117.81 | 70.22 | NA | 25.14 | 75.64 | 9.85 | 31.95 |
| | Average | −117.81 | 70.20 | NA | 25.12 | 77.44 | 10.16 | 32.69 |
| B) | | | | 22-carat gold alloy made in accordance with the present invention | | | | |
| 2 | | −105.25 | 66.21 | NA | 32.1 | 85.57 | 4.5 | 23.46 |
| | | −106.3 | 66.01 | NA | 32.2 | 85.62 | 4.25 | 24.05 |
| | | −105.85 | 66.0 | NA | 32.3 | 85.69 | 4.75 | 25.25 |
| | Average | −105.8 | 66.07 | NA | 32.2 | 85.61 | 4.5 | 24.25 |

Enhanced Hardness:

| | 22-carat Conventional Gold Alloy | 22-carat gold of the present invention |
|---|---|---|
| Work Hardened Hardness (Vickers HV-.05 ASM F 384-11) | Around 140 | 175-190 |

Springiness—Test Conducted by Compression Tester:

| | Springiness Observed in 22-carat Conventional Gold Alloy | Springiness Observed in 22-carat Gold Alloy of the present invention |
|---|---|---|
| Round specimen used is a bangle as the final product. Size-52.5 mm Inner Diameter and Thickness 0.8 to 0.85 mm | Up to appx. 800 gm and deflection of 3.5 mm | Up to appx. 925 gm and deflection of 3.95 mm |

Accordingly, from the above table, it is evident that the springiness witnessed in the gold alloy made in accordance with the present invention is substantially higher than the conventional 22-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 22-carat Gold Alloy) Test piece Size 20 mm × 20 mm × 0.3 mm | 2.12 | 2.024 | 0.096 | 4.528 |

-continued

Wear Resistance Test

| No. | Gold Alloy | Weight Before Test gm | Weight After Test gm | Weight Loss gm | % Loss |
|---|---|---|---|---|---|
| 2 | (22-carat Gold alloy of the present invention) Test piece Size 20 mm × 20 mm × 0.3 mm | 2.088 | 2.07 | .018 | .862 |

D1—23-Carat Having Compositions

| | |
|---|---|
| CONVENTIONAL ALLOY- | 95.8% BY WEIGHT OF GOLD<br>2.1% BY WEIGHT OF COPPER<br>2.1% BY WEIGHT OF SILVER |
| GOLD ALLOY ACCORDING TO THE PRESENT INVENTION - | 95.8% BY WEIGHT OF GOLD<br>0.25% BY WEIGHT OF ZIRCONIUM<br>0.25% BY WEIGHT OF MAGNESIUM<br>0.25% BY WEIGHT OF TITANIUM<br>2.58% BY WEIGHT OF COPPER<br>0.43% BY WEIGHT OF ZINC<br>0.43% BY WEIGHT OF SILVER |

Specific Gravity:

It has been tested and observed that the specific gravity of the 23-carat Gold alloy made according to the present invention is significantly reduced. While the conventional 23-carat gold has a specific gravity of 18.523 gm/cc, 23 carats gold alloy made in accordance with the present invention with the above composition has demonstrated a specific gravity of 17.88 gm/cc, which is 3.459% less than the conventional 23-carat gold alloy. This is a substantial cost-effectiveness for this high value metal used for jewelry manufacture.

Color Retention:

23-carat Gold alloy made according to the present invention is also compatible in terms of the color retention properties thereof, when compared with conventional 23-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 23-carat Gold Alloy | | | | |
| | | −142.06 | 61 | NA | 6.76 | 42.65 | 3.34 | 19.57 |
| | | −141.14 | 61.03 | NA | 6.53 | 42.75 | 3.39 | 19.87 |
| | | −140.46 | 60.93 | NA | 6.39 | 44.13 | 3.45 | 20.45 |
| | Average | −141.22 | 60.98 | NA | 6.56 | 43.18 | 3.39 | 19.96 |
| B) | | | | 23-carat Gold Alloy | | | | |
| | | −117.82 | 54.1 | NA | 7.1 | 41.31 | 3.64 | 15.1 |
| | | −117.36 | 53.84 | NA | 7.05 | 10.98 | 3.59 | 15.11 |
| | | −114.71 | 52.99 | NA | 6.95 | 41.01 | 3.64 | 15.08 |
| | Average | −116.63 | 53.64 | NA | 7.03 | 41.1 | 3.62 | 15.10 |

Enhanced Hardness:

| | 23-carat Conventional Gold Alloy | 23-carat Gold Alloy |
|---|---|---|
| Work Hardened Hardness (Vickers HV-.05 ASM F 384-11) | 85-100 | 125-155 |

Springiness—Test Conducted by Compression Tester:

| | Springiness Observed in 23-carat Conventional Gold Alloy | Springiness Observed in 23-carat Gold Alloy |
|---|---|---|
| Round specimen used is a bangle as the final product. Size-53 mm Inner Diameter and Thickness 0.95-1 mm | Up to appx. 90 gm and deflection of 4.16 mm | Up to appx. 225 gm and deflection of 8.66 mm |

Accordingly, from the above table, it is evident that the springiness witnessed in the Gold Alloy according to the present invention is almost more than double of applied load (pressure) in comparison with the conventional Gold alloy without Zirconium.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 23-carat Gold Alloy) Test piece Size 20 mmm × 20 mm × 0.3 mm | 2.222 | 2.172 | 0.050 | 2.250 |

-continued

Wear Resistance Test

| No. | Gold Alloy | Weight Before Test gm | Weight After Test gm | Weight Loss gm | % Loss |
|---|---|---|---|---|---|
| 2 | (23-carat Gold alloy of the present invention) Test piece Size 20 mm*20 mm*.3 mm | 2.138 | 2.112 | 0.026 | 1.216 |

D2—23-Carat Having Compositions

| | |
|---|---|
| CONVENTIONAL ALLOY- | 95.8% BY WEIGHT OF GOLD<br>2.1% BY WEIGHT OF COPPER<br>2.1% BY WEIGHT OF SILVER |
| GOLD ALLOY ACCORDING TO THE PRESENT INVENTION - | 95.8% BY WEIGHT OF GOLD<br>0.25% BY WEIGHT OF ZIRCONIUM<br>0.25% BY WEIGHT OF TITANIUM<br>2.78% BY WEIGHT OF COPPER<br>0.46% BY WEIGHT OF ZINK<br>0.46% BY WEIGHT OF SILVER |

Specific Gravity:

It has been tested and observed that the specific gravity of the 23-carat Gold alloy made according to the present invention is significantly reduced. While the conventional 23-carat gold has a specific gravity of 18.523 gm/cc, 23 carats gold alloy made in accordance with the present invention with the above composition has demonstrated a specific gravity of 18.27 gm/cc, which is 1.37% less than the conventional 23-carat gold alloy. This is a substantial cost-effectiveness for this high value metal used for jewelry manufacture.

Color Retention:

23-carat Gold alloy made according to the present invention is also compatible in terms of the color retention properties thereof, when compared with conventional 23-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 23-carat Gold Alloy | | | | |
| | | −142.06 | 61 | NA | 6.76 | 42.65 | 3.34 | 19.57 |
| | | −141.14 | 61.03 | NA | 6.53 | 42.75 | 3.39 | 19.87 |
| | | −140.46 | 60.93 | NA | 6.39 | 44.13 | 3.45 | 20.45 |
| | Average | −141.22 | 60.98 | NA | 6.56 | 43.18 | 3.39 | 19.96 |
| B) | | | | 23-carat Gold Alloy | | | | |
| | | −110.45 | 55.58 | NA | 7.15 | 42.05 | 4.04 | 12.25 |
| | | −112.48 | 51.23 | NA | 7.05 | 42.05 | 4.19 | 12.5 |
| | | −114.56 | 54.93 | NA | 8.15 | 41.99 | 4.17 | 12.75 |
| | Average | −112.49 | 53.91 | NA | 7.45 | 42.03 | 4.13 | 12.5 |

Enhanced Hardness:

| | 23-carat Conventional Gold Alloy | 23-carat Gold Alloy |
|---|---|---|
| Work Hardened Hardness (Vickers HV-.05 ASM F 384-11) | 85-100 | 145-155 |

Springiness—Test Conducted By Compression Tester:

| | Springiness Observed in 23-carat Conventional Gold Alloy | Springiness Observed in 23-carat Gold Alloy |
|---|---|---|
| Round specimen used is a bangle as the final product. Size-53 mm Inner Diameter and Thickness 0.95-1 mm | Up to appx. 90 gm and deflection of 4.16 mm | Up to appx. 135 gm and deflection of 5.65 mm |

Accordingly, from the above table, it is evident that the springiness witnessed in the Gold Alloy according to the present invention is almost more than double of applied load (pressure) in comparison with the conventional Gold alloy without Zirconium.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 23-carat Gold Alloy) Test piece Size 20 mmm × 20 mm × 0.3 mm | 2.222 | 2.172 | 0.050 | 2.250 |

-continued

Wear Resistance Test

| No. | Gold Alloy | Weight Before Test gm | Weight After Test gm | Weight Loss gm | % Loss |
|---|---|---|---|---|---|
| 2 | (23-carat Gold alloy of the present invention) Test piece Size 20 mm*20 mm*.3 mm | 2.192 | 2.165 | 0.026 | 1.12 |

D3—23-Carat Having Compositions

| | |
|---|---|
| CONVENTIONAL ALLOY- | 95.8% BY WEIGHT OF GOLD<br>2.1% BY WEIGHT OF COPPER<br>2.1% BY WEIGHT OF SILVER |
| GOLD ALLOY ACCORDING TO THE PRESENT INVENTION - | 95.8% BY WEIGHT OF GOLD<br>0.25% BY WEIGHT OF ZIRCONIUM<br>0.25% BY WEIGHT OF MAGNESIUM<br>2.78% BY WEIGHT OF COPPER<br>0.46% BY WEIGHT OF ZINK<br>0.46% BY WEIGHT OF SILVER |

Specific Gravity:

It has been tested and observed that the specific gravity of the 23-carat Gold alloy made according to the present invention is significantly reduced. While the conventional 23-carat gold has a specific gravity of 18.523 gm/cc, 23 carats gold alloy made in accordance with the present invention with the above composition has demonstrated a specific gravity of 17.97 gm/cc, which is 2.94% less than the conventional 23-carat gold alloy. This is a substantial cost-effectiveness for this high value metal used for jewelry manufacture.

Color Retention:

23-carat Gold alloy made according to the present invention is also compatible in terms of the color retention properties thereof, when compared with conventional 23-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 23-carat Gold Alloy | | | | |
| | | −142.06 | 61 | NA | 6.76 | 42.65 | 3.34 | 19.57 |
| | | −141.14 | 61.03 | NA | 6.53 | 42.75 | 3.39 | 19.87 |
| | | −140.46 | 60.93 | NA | 6.39 | 44.13 | 3.45 | 20.45 |
| | Average | −141.22 | 60.98 | NA | 6.56 | 43.18 | 3.39 | 19.96 |
| B) | | | | 23-carat Gold Alloy | | | | |
| | | −118.38 | 56.07 | NA | 6.25 | 40.05 | 3.01 | 14.47 |
| | | −118.17 | 56.11 | NA | 5.99 | 40.10 | 2.87 | 14.67 |
| | | −117.97 | 56.18 | NA | 6.15 | 40.0 | 2.92 | 14.83 |
| | Average | −118.37 | 56.12 | NA | 6.13 | 40.05 | 2.93 | 14.65 |

Enhanced Hardness:

| | 23-carat Conventional Gold Alloy | 23-carat Gold Alloy |
|---|---|---|
| Work Hardened Hardness (Vickers HV-.05 ASM F 384-11) | 85-100 | 125-135 |

Springiness—Test Conducted By Compression Tester:

| | Springiness Observed in 23-carat Conventional Gold Alloy | Springiness Observed in 23-carat Gold Alloy |
|---|---|---|
| Round specimen used is a bangle as the final product. Size-53 mm Inner Diameter and Thickness 0.95-1 mm | Up to appx. 90 gm and deflection of 4.16 mm | Up to appx. 215 gm and deflection of 7.90 mm |

Accordingly, from the above table, it is evident that the springiness witnessed in the Gold Alloy according to the present invention is almost more than double of applied load (pressure) in comparison with the conventional Gold alloy without Zirconium.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 23-carat Gold Alloy) Test piece Size 20 mmm × 20 mm × 0.3 mm | 2.222 | 2.172 | 0.050 | 2.250 |

-continued

Wear Resistance Test

| No. | Gold Alloy | Weight Before Test gm | Weight After Test gm | Weight Loss gm | % Loss |
|---|---|---|---|---|---|
| 2 | (23-carat Gold alloy of the present invention) Test piece Size 20 mm*20 mm*.3 mm | 2.16 | 2.126 | 0..033 | 1.56 |

D4—23-Carat Having Compositions

| | |
|---|---|
| CONVENTIONAL ALLOY- | 95.8% BY WEIGHT OF GOLD<br>2.1% BY WEIGHT OF COPPER<br>2.1% BY WEIGHT OF SILVER |
| GOLD ALLOY ACCORDING TO THE PRESENT INVENTION - | 95.8% BY WEIGHT OF GOLD<br>0.25% BY WEIGHT OF TITANIUM<br>0.25% BY WEIGHT OF MAGNESIUM<br>2.78% BY WEIGHT OF COPPER<br>0.46% BY WEIGHT OF ZINK<br>0.46% BY WEIGHT OF SILVER |

Specific Gravity:

It has been tested and observed that the specific gravity of the 23-carat Gold alloy made according to the present invention is significantly reduced. While the conventional 23-carat gold has a specific gravity of 18.523 gm/cc, 23 carats gold alloy made in accordance with the present invention with the above composition has demonstrated a specific gravity of 17.92 gm/cc, which is 3.24% less than the conventional 23-carat gold alloy. This is a substantial cost-effectiveness for this high value metal used for jewelry manufacture.

Color Retention:

23-carat Gold alloy made according to the present invention is also compatible in terms of the color retention properties thereof, when compared with conventional 23-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 23-carat Gold Alloy | | | | |
| | | −142.06 | 61 | NA | 6.76 | 42.65 | 3.34 | 19.57 |
| | | −141.14 | 61.03 | NA | 6.53 | 42.75 | 3.39 | 19.87 |
| | | −140.46 | 60.93 | NA | 6.39 | 44.13 | 3.45 | 20.45 |
| | Average | −141.22 | 60.98 | NA | 6.56 | 43.18 | 3.39 | 19.96 |
| B) | | | | 23-carat Gold Alloy | | | | |
| | | −117.00 | 55.81 | NA | 8.01 | 43.48 | 3.51 | 10.11 |
| | | −117.00 | 55.67 | NA | 7.95 | 43.12 | 3.45 | 10.23 |
| | | −117.00 | 55.54 | NA | 8.00 | 43.23 | 3.39 | 10.26 |
| | Average | −117.00 | 55.67 | NA | 7.98 | 43.27 | 3.45 | 10.2 |

Enhanced Hardness:

| | 23-carat Conventional Gold Alloy | 23-carat Gold Alloy |
|---|---|---|
| Work Hardened Hardness (Vickers HV-.05 ASM F 384-11) | 85-100 | 135-150 |

Springiness—Test Conducted By Compression Tester:

| | Springiness Observed in 23-carat Conventional Gold Alloy | Springiness Observed in 23-carat Gold Alloy |
|---|---|---|
| Round specimen used is a bangle as the final product. Size-53 mm Inner Diameter and Thickness 0.95-1 mm | Up to appx. 90 gm and deflection of 4.16 mm | Up to appx. 180 gm and deflection of 6.65 mm |

Accordingly, from the above table, it is evident that the springiness witnessed in the Gold Alloy according to the present invention is almost more than double of applied load (pressure) in comparison with the conventional Gold alloy without Zirconium.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 23-carat Gold Alloy) Test piece Size 20 mmm × 20 mm × 0.3 mm | 2.222 | 2.172 | 0.050 | 2.250 |

-continued

Wear Resistance Test

| No. | Gold Alloy | Weight Before Test gm | Weight After Test gm | Weight Loss gm | % Loss |
|---|---|---|---|---|---|
| 2 | (23-carat Gold alloy of the present invention) Test piece Size 20 mm*20 mm*.3 mm | 2.15 | 2.119 | 0..030 | 1.44 |

E1—24-Carat Having Compositions

| | |
|---|---|
| CONVENTIONAL ALLOY- | 99.5% BY WEIGHT OF GOLD<br>0.5% BY WEIGHT OF SILVER |
| GOLD ALLOY ACCORDING TO THE PRESENT INVENTION: | 99.5% BY WEIGHT OF GOLD<br>0.15% BY WEIGHT OF ZIRCONIUM<br>0.15% BY WEIGHT OF TITANIUM<br>0.20% BY WEIGHT OF MAGNESIUM |

Specific Gravity:

It has been tested and observed that the specific gravity of the 24-carat Gold alloy made according to the present invention is reduced by the above composition. While the conventional 24-carat gold has a specific gravity of 19.219 gm/cc, 24-carat gold alloy made in accordance with the present invention with the above composition has demonstrated a specific gravity of 18.771 gm/cc, which is 2.33% lesser than the conventional 24-carat gold alloy. This is a substantial cost-effectiveness for this high value metal used for jewelry manufacture.

Color Retention:

24-carat Gold alloy made according to the present invention is also compatible in terms of the color retention properties thereof when compared with conventional 24-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 24-carat Gold Alloy | | | | |
| 1 | | −150.47 | 77.53 | NA | 19.49 | 73.25 | 8.85 | 36.49 |
| | | −150.65 | 77.49 | NA | 19.5 | 73.26 | 8.86 | 36.51 |
| | | −148.92 | 77.27 | NA | 19.89 | 73.06 | 8.9 | 36.95 |
| | Average | −150.01 | 77.43 | NA | 19.63 | 73.19 | 8.87 | 36.65 |
| B) | | | | 24-carat gold alloy made in accordance with the present invention | | | | |
| 2 | | −146.68 | 73.32 | NA | 24.47 | 80.45 | 8.01 | 41.32 |
| | | −146.79 | 73.37 | NA | 24.34 | 80.44 | 8.02 | 41.38 |
| | | −146.98 | 73.42 | NA | 24.32 | 80.46 | 8.04 | 41.35 |
| | Average | −146.82 | 73.37 | NA | 24.38 | 80.45 | 8.02 | 41.35 |

Enhanced Hardness:

| | 24-carat Conventional Gold Alloy | 24-carat gold of the present invention |
|---|---|---|
| Work Hardened Hardness (Vickers HV-.05 ASM F 384-11) | Around 55 | 75-100 |

Springiness—Test Conducted by Compression Tester:

| | Springiness Observed in 24-carat Conventional Gold Alloy | Springiness Observed in 24-carat gold alloy of the present invention |
|---|---|---|
| Round specimen used is a bangle as the final product. Size-52.5 mm Inner Diameter and Thickness 0.8 to 0.85 mm | Up to appx. 75 gm and deflection of 0.15 mm | Up to appx. 255 gm and deflection of. 8 mm |

Accordingly, from the above table, it is evident that the springiness witnessed in the gold alloy made in accordance with the present invention is substantially higher in comparison with the conventional 24-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 24-carat Gold Alloy) Test piece Size 20 mm*20 mm*.3 mm | 2.306 | 2.216 | 0.090 | 3.902 |
| 2 | (24-carat Gold alloy of the present invention) Test piece Size 20 mm*20 mm*.3 mm | 2.252 | 2.218 | 0.034 | 1.530 |

E2—24-Carat Having Compositions

| | |
|---|---|
| CONVENTIONAL ALLOY- | 99.5% BY WEIGHT OF GOLD<br>0.5% BY WEIGHT OF SILVER |
| GOLD ALLOY ACCORDING TO THE PRESENT INVENTION- | 99.5% BY WEIGHT OF GOLD<br>0.25% BY WEIGHT OF ZIRCONIUM<br>0.25% BY WEIGHT OF TITANIUM |

Specific Gravity:

It has been tested and observed that the specific gravity of the 24-carat Gold alloy made according to the present invention is reduced by the above composition. While the conventional 24-carat gold has a specific gravity of 19.219 gm/cc, 24-carat gold alloy made in accordance with the present invention with the above composition has demonstrated a specific gravity of 19.05 gm/cc, which is 0.88% lesser than the conventional 24-carat gold alloy. This is a substantial cost-effectiveness for this high value metal used for jewelry manufacture.

Color Retention:

24-carat Gold alloy made according to the present invention is also compatible in terms of the color retention properties thereof, when compared with conventional 24-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 24-carat Gold Alloy | | | | |
| 1 | | −150.47 | 77.53 | NA | 19.49 | 73.25 | 8.85 | 36.49 |
| | | −150.65 | 77.49 | NA | 19.5 | 73.26 | 8.86 | 36.51 |
| | | −148.92 | 77.27 | NA | 19.89 | 73.06 | 8.9 | 36.95 |
| | Average | −150.01 | 77.43 | NA | 19.63 | 73.19 | 8.87 | 36.65 |
| B) | | | | 24-carat gold alloy made in accordance with the present invention | | | | |
| 2 | | −145.12 | 71.52 | NA | 28.38 | 81.45 | 6.58 | 37.87 |
| | | −145.78 | 71.25 | NA | 29.05 | 81.5 | 7.02 | 37.03 |
| | | −145.85 | 71.30 | NA | 28.93 | 81.4 | 7.23 | 37.11 |
| | Average | −145.53 | 71.35 | NA | 28.79 | 81.45 | 6.94 | 37.33 |

Enhanced Hardness:

| | 24-carat Conventional Gold Alloy | 24-carat gold of the present invention |
|---|---|---|
| Work Hardened Hardness (Vickers HV-.05 ASM F 384-11) | Around 55 | 75-105 |

Springiness—Test Conducted by Compression Tester:

| | Springiness Observed in 24-carat Conventional Gold Alloy | Springiness Observed in 24-carat gold alloy of the present invention |
|---|---|---|
| Round specimen used is a bangle as the final product. Size-52.5 mm Inner Diameter and Thickness 0.8 to 0.85 mm | Up to appx. 75 gm and deflection of 0.15 mm | Up to appx. 95 gm and deflection of .3 mm |

Accordingly, from the above table, it is evident that the springiness witnessed in the gold alloy made in accordance with the present invention is substantially higher in comparison with the conventional 24-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 24-carat Gold Alloy) Test piece Size 20 mm*20 mm*.3 mm | 2.306 | 2.216 | 0.090 | 3.902 |
| 2 | (24-carat Gold alloy of the present invention) Test piece Size 20 mm*20 mm*.3 mm | 2.286 | 2.249 | 0.037 | 1.61 |

E3—24-Carat Having Compositions

| | |
|---|---|
| CONVENTIONAL ALLOY-GOLD ALLOY | 99.5% BY WEIGHT OF GOLD<br>0.5% BY WEIGHT OF SILVER |
| ACCORDING TO THE PRESENT INVENTION- | 99.5% BY WEIGHT OF GOLD<br>0.25% BY WEIGHT OF ZIRCONIUM<br>0.25% BY WEIGHT OF MAGNESIUM |

Specific Gravity:

It has been tested and observed that the specific gravity of the 24-carat Gold alloy made according to the present invention is reduced by the above composition. While the conventional 24-carat gold has a specific gravity of 19.219 gm/cc, 24-carat gold alloy made in accordance with the present invention with the above composition has demonstrated a specific gravity of 18.73 gm/cc, which is 2.53% lesser than the conventional 24-carat gold alloy. This is a substantial cost-effectiveness for this high value metal used for jewelry manufacture.

Color Retention:

24-carat Gold alloy made according to the present invention is also compatible in terms of the color retention properties thereof, when compared with conventional 24-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 24-carat Gold Alloy | | | | |
| 1 | | −150.47 | 77.53 | NA | 19.49 | 73.25 | 8.85 | 36.49 |
| | | −150.65 | 77.49 | NA | 19.5 | 73.26 | 8.86 | 36.51 |
| | | −148.92 | 77.27 | NA | 19.89 | 73.06 | 8.9 | 36.95 |
| | Average | −150.01 | 77.43 | NA | 19.63 | 73.19 | 8.87 | 36.65 |
| B) | | | | 24-carat gold alloy made in accordance with the present invention | | | | |
| 2 | | −146.0 | 74.88 | NA | 27.09 | 80.05 | 6.00 | 36.10 |
| | | −146.05 | 74.56 | NA | 27.12 | 80.37 | 5.75 | 36.5 |
| | | −146.13 | 74.51 | NA | 26.99 | 80.23 | 5.95 | 36.65 |
| | Average | −146.04 | 74.65 | NA | 27.06 | 80.21 | 5.9 | 36.41 |

Enhanced Hardness:

| | 24-carat Conventional Gold Alloy | 24-carat gold of the present invention |
|---|---|---|
| Work Hardened Hardness (Vickers HV-.05 ASM F 384-11) | Around 55 | 80-95 |

Springiness—Test Conducted by Compression Tester:

| | Springiness Observed in 24-carat Conventional Gold Alloy | Springiness Observed in 24-carat gold alloy of the present invention |
|---|---|---|
| Round specimen used is a bangle as the final product. Size-52.5 mm Inner Diameter and Thickness 0.8 to 0.85 mm | Up to appx. 75 gm and deflection of 0.15 mm | Up to appx. 200 gm and deflection of .6 mm |

Accordingly, from the above table, it is evident that the springiness witnessed in the gold alloy made in accordance with the present invention is substantially higher in comparison with the conventional 24-carat Gold alloy.

Higher Resistance to Wear:

Test Conducted with media polishing set up in which ceramic is used as media for 2 Hours:

Wear Resistance Test

| No. | Gold Alloy | Weight Before Test gm | Weight After Test gm | Weight Loss gm | % Loss |
|---|---|---|---|---|---|
| 1 | (Conventional 24-carat Gold Alloy) Test piece Size 20 mm*20 mm*.3 mm | 2.306 | 2.216 | 0.090 | 3.902 |
| 2 | (24-carat Gold alloy of the present invention) Test piece Size 20 mm*20 mm*.3 mm | 2.248 | 2.204 | 0.044 | 1.95 |

E4—24-Carat Having Compositions

| | |
|---|---|
| CONVENTIONAL ALLOY- | 99.5% BY WEIGHT OF GOLD<br>0.5% BY WEIGHT OF SILVER |
| GOLD ALLOY ACCORDING TO THE PRESENT INVENTION- | 99.5% BY WEIGHT OF GOLD<br>0.25% BY WEIGHT OF TITANIUM<br>0.25% BY WEIGHT OF MAGNESIUM |

Specific Gravity:

It has been tested and observed that the specific gravity of the 24-carat Gold alloy made according to the present invention is reduced by the above composition. While the conventional 24-carat gold has a specific gravity of 19.219 gm/cc, 24-carat gold alloy made in accordance with the present invention with the above composition has demonstrated a specific gravity of 18.67 gm/cc, which is 2.84% lesser than the conventional 24-carat gold alloy. This is a substantial cost-effectiveness for this high value metal used for jewelry manufacture.

Color Retention:

24-carat Gold alloy made according to the present invention is also compatible in terms of the color retention properties thereof, when compared with conventional 24-carat Gold alloys as observed under (CIE Defined) color spectrograph.

Size of test pieces 21 mm×21 mm×0.32 mm:

| No. | Side | WI-CIE (Whiteness) | YI-E3I3 (Yellowness) | Opacity | TB-452 (Brightness) | Coordinate L* | Coordinate a* | Coordinate b* |
|---|---|---|---|---|---|---|---|---|
| A) | | | | Conventional 24-carat Gold Alloy | | | | |
| 1 | | −150.47 | 77.53 | NA | 19.49 | 73.25 | 8.85 | 36.49 |
| | | −150.65 | 77.49 | NA | 19.5 | 73.26 | 8.86 | 36.51 |
| | | −148.92 | 77.27 | NA | 19.89 | 73.06 | 8.9 | 36.95 |
| | Average | −150.01 | 77.43 | NA | 19.63 | 73.19 | 8.87 | 36.65 |
| B) | | | | 24-carat gold alloy made in accordance with the present invention | | | | |
| 2 | | −147.13 | 73.02 | NA | 25.05 | 79.12 | 7.1 | 34.12 |
| | | −147.14 | 73.18 | NA | 25.52 | 79.67 | 7.1 | 34.23 |
| | | −147.15 | 73.58 | NA | 25.73 | 79.62 | 7.1 | 34.36 |
| | Average | −147.14 | 73.26 | NA | 25.43 | 79.47 | 7.1 | 34.23 |

Enhanced Hardness:

| | 24-carat Conventional Gold Alloy | 24-carat gold of the present invention |
|---|---|---|
| Work Hardened Hardness (Vickers HV-.05 ASM F 384-11) | Around 55 | 75-100 |

Springiness—Test Conducted by Compression Tester:

| | Springiness Observed in 24-carat Conventional Gold Alloy | Springiness Observed in 24-carat gold alloy of the present invention |
|---|---|---|
| Round specimen used is a bangle as the final product. Size-52.5 mm Inner Diameter and Thickness 0.8 to 0.85 mm | Up to appx. 75 gm and deflection of 0.15 mm | Up to appx. 140 gm and deflection of .45 mm |

Accordingly, from the above table, it is evident that the springiness witnessed in the gold alloy made in accordance with the present invention is substantially higher in comparison with the conventional 24-carat Gold alloy.

Higher Resistance to Wear:

Test Conducted with media polishing set up in which ceramic is used as media for 2 Hours:

| Wear Resistance Test | | | | | |
|---|---|---|---|---|---|
| No. | Gold Alloy | Weight Before Test gm | Weight After Test gm | Weight Loss gm | % Loss |
| 1 | (Conventional 24-carat Gold Alloy) Test piece Size 20 mm*20 mm*.3 mm | 2.306 | 2.216 | 0.090 | 3.902 |
| 2 | (24-carat Gold alloy of the present invention) Test piece Size 20 mm*20 mm*.3 mm | 2.240 | 2.201 | 0.039 | 1.73 |

TECHNICAL ADVANTAGES & ECONOMIC SIGNIFICANCE

Some of the technical advantages of the gold alloy containing at least two out of zirconium, magnesium and titanium or all three together as an alloying element made in accordance with the present invention are as under:

- Lower weight for the same volume in comparison to the conventional Gold alloy
- Color retention in jewelry manufacture from this alloy is compatible in terms of the color retention properties and as observed under (CIE Defined) color spectrograph with conventional alloy
- Offers a workable malleability and ductility in jewelry manufacture
- Age Hardening
- Enhanced Hardness
- Improved Springiness (Resilience)
- Higher resistance to wear
- Better Luster Throughout this specification, the word "comprise", or variations such as "comprises" or "comprising", shall be understood to implies including a described element, integer or method step, or group of elements, integers or method steps, however, does not imply excluding any other element, integer or step, or group of elements, integers or method steps.

The use of the expression "a", "at least" or "at least one" shall imply using one or more elements or ingredients or quantities, as used in the embodiment of the disclosure in order to achieve one or more of the intended objects or results of the present invention.

The exemplary embodiments described in this specification are intended merely to provide an understanding of various manners in which this embodiment may be used and to further enable the skilled person in the relevant art to practice this invention. The description provided herein is purely by way of example and illustration.

Although the embodiments presented in this disclosure have been described in terms of its preferred embodiments, the skilled person in the art would readily recognize that these embodiments can be applied with modifications possible within the spirit and scope of the present invention as described in this specification by making innumerable changes, variations, modifications, alterations and/or integrations in terms of materials and method used to configure, manufacture and assemble various constituents, components, subassemblies and assemblies, in terms of their size, shapes, orientations and interrelationships without departing from the scope and spirit of the present invention.

While considerable emphasis has been placed on the specific features of the preferred embodiment described here, it will be appreciated that many additional features can be added and that many changes can be made in the preferred embodiments without departing from the principles of the invention.

These and other changes in the preferred embodiment of the invention will be apparent to those skilled in the art from the disclosure herein, whereby it is to be distinctly understood that the foregoing descriptive matter is to be interpreted merely as illustrative of the invention and not as a limitation.

We claim:

1. A gold alloy composition for jewellery manufacture, wherein the gold alloy composition is alloyed with zirconium, titanium, and magnesium, the gold alloy composition consisting of:

75 to 99.5% by weight of gold,
0.01 to 1.5% by weight of zirconium,
0.01 to 1.5% by weight of magnesium,
0.01 to 1.5% by weight of titanium,
0 to 24.98% by weight of copper,
0 to 6.225% by weight of zinc,
0 to 6.225% by weight of silver; and
wherein:
zinc and silver are present in equal amounts by weight in the gold alloy composition;

the gold alloy composition has lower specific gravity, higher springiness, and higher wear resistance than a ternary gold alloy consisting of gold, copper, and silver; and the gold alloy composition and the ternary gold alloy contain an identical gold content.

2. A gold alloy composition for jewellery manufacture, wherein the gold alloy is an 18-carat gold alloy having a specific gravity of 14.67 g/cc; and a hardness of 240-260 Vickers HV-0.05 ASM F 384-11, the gold alloy composition consisting of:

75 to 75.5% by weight of gold, 0.01 to 1.5% by weight of magnesium, 0.01 to 1.5% by weight of titanium, 0.01 to 1.5% by weight of zirconium, 0 to 24.97% by weight of copper, 0 to 24.98% by weight of zinc, and 0 to 24.98% by weight of silver.

3. A gold alloy composition for jewellery manufacture, wherein the gold alloy is a 21-carat gold alloy having a specific gravity of 16.502 g/cc; hardness of 200-225 Vickers HV-0.05 ASM F 384-11, the gold alloy composition consisting essentially of:

87.5 to 88% by weight of gold, 0.01 to 1.5% by weight of magnesium, 0.01 to 1.5% by weight of titanium, 0.01 to 1.5% by weight of zirconium, 0 to 12.47% by weight of copper, 0 to 3.05% by weight of zinc, and 0 to 3.05% by weight of Silver;

wherein zinc and silver are present in equal amounts by weight in the gold alloy composition.

4. The gold alloy composition as claimed in claim 1, wherein the gold alloy is a 22-carat gold alloy having a specific gravity of 17.057 g/cc; hardness of 170-195 Vickers HV-0.05 ASM F 384-11 consisting of:

91.6 to 92% by weight of gold, 0.01 to 1.5% by weight of magnesium, 0.01 to 1.5% by weight of titanium, 0.01 to 1.5% by weight of Zirconium, 0 to 8.37% by weight of copper, 0 to 1.975% by weight of zinc, and 0 to 1.975% by weight of silver.

5. The gold alloy composition as claimed in claim 1, wherein the gold alloy is a 23-carat gold alloy having a specific gravity of 17.88 g/cc; hardness of 125-155 Vickers HV-0.05 ASM F 384-11 consisting of:

95.8 to 97% by weight of gold, 0.01 to 1.5% by weight of magnesium, 0.01 to 1.5% by weight of titanium, 0.01 to 1.5% by weight of Zirconium 0 to 4.17% by weight of copper, 0 to 0.46% by weight of zinc, and 0 to 0.46% by weight of silver.

6. The gold alloy composition as claimed in claim 1, wherein the gold alloy is a 24-carat gold alloy having a specific gravity of 18.771 g/cc; hardness of 75-100 Vickers HV-0.05 ASM F 384-11 consisting of:

97 to 99.5% by weight of gold, 0.01 to 1.5% by weight of magnesium, 0.01 to 1.5% by weight of titanium, 0.01 to 1.5% by weight of Zirconium.

7. A gold alloy composition for jewellery manufacture, the gold alloy composition consisting of:

a) 75 to 97% by weight of gold, b) a combination of at least two components selected from the group consisting of:

0.01 to 1.5% by weight of zirconium, 0.01 to 1.5% by weight of magnesium, and 0.01 to 1.5% by weight of titanium, c) 0 to 24.98% by weight of copper, d) 0 to 6.225% by weight of zinc, e) 0 to 6.225% by weight of Silver;

wherein zinc and silver are present in equal amounts by weight in the gold alloy composition;

wherein the gold alloy composition has lower specific gravity, higher springiness, and higher wear resistance than a ternary gold alloy consisting of gold, copper, and silver;

wherein the gold alloy composition and the ternary gold alloy contain an identical gold content.

8. A gold alloy composition for jewellery manufacture, wherein the gold alloy is a 18-carat gold alloy having a specific gravity of 14.74 to 14.78 g/cc; and a hardness of 235-265 Vickers HV-0.05 ASM F 384-11, the gold alloy composition consisting of;

75 to 75.5% by weight of gold, at least two of:

0.01 to 1.5% by weight of zirconium, 0.01 to 1.5% by weight of titanium, and 0.01 to 1.5% by weight of magnesium, 0 to 24.98% by weight of copper, 0 to 24.98% by weight of zinc, and 0 to 24.98% by weight of silver.

9. The gold alloy composition as claimed in claim 8, wherein the gold alloy is a 18-carat gold alloy having a specific gravity of 14.75 g/cc; hardness of 235-255 Vickers HV-0.05 ASM F 384-11 consisting of;

75 to 75.5% by weight of gold, 0.01 to 1.5% by weight of zirconium, 0.01 to 1.5% by weight of magnesium, 0 to 24.98% by weight of copper, 0 to 24.98% by weight of zinc, and 0 to 24.98% by weight of silver.

10. The gold alloy composition as claimed in claim 8, wherein the gold alloy is a 18-carat gold alloy having a specific gravity of 14.74 g/cc; hardness of 245-255 Vickers HV-0.05 ASM F 384-11 consisting of;

75 to 75.5% by weight of gold, 0.01 to 1.5% by weight of magnesium, 0.01 to 1.5% by weight of titanium, 0 to 24.98% by weight of copper, 0 to 24.98% by weight of zinc, and 0 to 24.98% by weight of silver.

11. A gold alloy composition for jewellery manufacture, wherein the gold alloy is a 21-carat gold alloy having a specific gravity of 16.55 g/cc; and a hardness of 200-210 Vickers HV-0.05 ASM F 384-11, the gold alloy composition consisting essentially of:

87.5 to 88% by weight of gold, 0.01 to 1.5% by weight of zirconium, 0.01 to 1.5% by weight of magnesium, 0 to 12.48% by weight of copper, 0 to 12.48% by weight of zinc, and 0 to 12.48% by weight of silver.

12. A gold alloy composition for jewellery manufacture, wherein the gold alloy is a 21-carat gold alloy having a specific gravity of 16.51 g/cc; and a hardness of 200-225 Vickers HV-0.05 ASM F 384-11, the gold alloy composition consisting essentially of:

87.5 to 88% by weight of gold,
0.01 to 1.5% by weight of magnesium,
0.01 to 1.5% by weight of titanium,
0 to 12.48% by weight of copper,
0 to 12.48% by weight of zinc, and
0 to 12.48% by weight of silver.

13. The gold alloy composition as claimed in claim 7, wherein the gold alloy is a 22-carat gold alloy having a specific gravity of 17.14 g/cc; hardness of 190-205 Vickers HV-0.05 ASM F 384-11 consisting of:

91.6 to 92% by weight of gold,
0.01 to 1.5% by weight of zirconium,
0.01 to 1.5% by weight of magnesium,
0 to 8.38% by weight of copper,
0 to 1.975% by weight of zinc, and
0 to 1.975% by weight of silver.

14. The gold alloy composition as claimed in claim 7, wherein the gold alloy is a 22-carat gold alloy having a specific gravity of 17.08 g/cc; hardness of 170-195 Vickers HV-0.05 ASM F 384-11 consisting of:

91.6 to 92% by weight of gold,
0.01 to 1.5% by weight of magnesium,
0.01 to 1.5% by weight of titanium,
0 to 8.38% by weight of copper,
0 to 1.975% by weight of zinc, and
0 to 1.975% by weight of silver.

15. The gold alloy composition as claimed in claim 7, wherein the gold alloy is a 23-carat gold alloy having a specific gravity of 17.97 g/cc; hardness of 125-135 Vickers HV-0.05 ASM F 384-11 consisting of:

95.8 to 97% by weight of gold,
0.01 to 1.5% by weight of zirconium,
0.01 to 1.5% by weight of magnesium,
0 to 4.18% by weight of copper,
0 to 0.46% by weight of zinc, and
0 to 0.46% by weight of silver.

16. The gold alloy composition as claimed in claim 7, wherein the gold alloy is a 23-carat gold alloy having a specific gravity of 17.92 g/cc; hardness of 135-150 Vickers HV-0.05 ASM F 384-11 consisting of:

95.8 to 97% by weight of gold,
0.01 to 1.5% by weight of magnesium,
0.01 to 1.5% by weight of titanium,
0 to 4.18% by weight of copper,
0 to 0.46% by weight of zinc, and
0 to 0.46% by weight of silver.

17. The gold alloy composition as claimed in claim 1, wherein the gold alloy is a 24-carat gold alloy having a specific gravity of 18.73 g/cc, hardness of 80-95 Vickers HV-0.05 ASM F 384-11 consisting of:

97 to 99.5% by weight of gold,
0.01 to 1.5% by weight of zirconium, and
0.01 to 1.5% by weight of Magnesium.

18. The gold alloy composition as claimed in claim 1, wherein the gold alloy is a 24-carat gold alloy having a specific gravity of 18.67 g/cc; hardness of 75-100 Vickers HV-0.05 ASM F 384-11 consisting of:

97 to 99.5% by weight of gold,
0.1 to 1.5% by weight of magnesium, and
0.1 to 1.5% by weight of Titanium.

19. A gold alloy composition for jewellery manufacture, the gold alloy composition comprising:

a) 87.5 to 97% by weight of gold,
b) at least two components selected from the group consisting of:
0.01 to 1.5% by weight of zirconium, and
0.01 to 1.5% by weight of magnesium,
0.01 to 1.5% by weight of titanium,
c) 0 to 12.48% by weight of copper,
d) 0 to 3.05% by weight of zinc,
e) 0% to 3.05% by weight of silver;

wherein zinc and silver are present in equal amounts by weight in the gold alloy composition;

wherein the gold alloy composition has lower specific gravity, higher springiness, and higher wear resistance than a ternary gold alloy consisting of gold, copper, and silver;

wherein the gold alloy composition and the ternary gold alloy contain an identical gold content.

20. The gold alloy composition as claimed in claim 8, wherein the gold alloy is a 18-carat gold alloy having a specific gravity of 14.78 g/cc; and a hardness of 245-265 Vickers HV-0.05 ASM F 384-11, the gold alloy composition consisting of;

75 to 75.5% by weight of gold,
0.01 to 1.5% by weight of zirconium,
0.01 to 1.5% by weight of titanium,
0 to 24.98% by weight of copper,
0 to 24.98% by weight of zinc, and
0 to 24.98% by weight of silver.

21. The gold alloy composition as claimed in claim 19, wherein the gold alloy is a 21-carat gold alloy having a specific gravity of 16.69 g/cc; hardness of 205-230 Vickers HV-0.05 ASM F 384-11 consisting essentially of:

87.5 to 88% by weight of gold,
0.01 to 1.5% by weight of zirconium,
0.01 to 1.5% by weight of titanium,
0 to 12.48% by weight of copper,
0 to 3.05% by weight of zinc,
0 to 3.05% by weight of silver.

22. The gold alloy composition as claimed in claim 19, wherein the gold alloy is a 22-carat gold alloy having a specific gravity of 17.40 g/cc; hardness of 175-190 Vickers HV-0.05 ASM F 384-11 comprising:

91.6 to 92% by weight of gold,
0.01 to 1.5% by weight of zirconium,
0.01 to 1.5% by weight of titanium,
0 to 8.38% by weight of copper,
0 to 1.975% by weight of zinc, and
0% to 1.975% by weight of silver.

23. The gold alloy composition as claimed in claim 19, wherein the gold alloy is a 23-carat gold alloy having a specific gravity of 18.27 g/cc; hardness of 145-155 Vickers HV-0.05 ASM F 384-11 comprising:

95.8 to 97% by weight of gold,
0.01 to 1.5% by weight of zirconium,
0.01 to 1.5% by weight of titanium,
0 to 4.18% by weight of copper,
0 to 0.46% by weight of zinc, and
0 to 0.46% by weight of silver.

* * * * *